US011993912B2

(12) United States Patent
Imura et al.

(10) Patent No.: US 11,993,912 B2
(45) Date of Patent: May 28, 2024

(54) WORK MACHINE HAVING A MOVABLE BODY OR A MOVABLY MOUNTED WORK IMPLEMENT AND A CONTROL UNIT CONFIGURED TO CALCULATE CLEARANCE AMOUNTS AND COMPARING THEM TO THRESHOLDS

(71) Applicant: HITACHI CONSTRUCTION MACHINERY CO., LTD., Tokyo (JP)

(72) Inventors: Shinya Imura, Ibaraki (JP); Masamichi Ito, Ibaraki (JP); Hidekazu Moriki, Tokyo (JP); Yuho Saito, Tokyo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 380 days.

(21) Appl. No.: 17/433,616

(22) PCT Filed: Sep. 30, 2019

(86) PCT No.: PCT/JP2019/038465
§ 371 (c)(1),
(2) Date: Aug. 25, 2021

(87) PCT Pub. No.: WO2021/064775
PCT Pub. Date: Apr. 8, 2021

(65) Prior Publication Data
US 2022/0145579 A1 May 12, 2022

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/123* (2013.01); *E02F 9/2033* (2013.01);
(Continued)

(58) Field of Classification Search
CPC ... E02F 3/32; E02F 3/435; E02F 9/123; E02F 9/2033; E02F 9/2203; E02F 9/2271;
(Continued)

(56) References Cited

U.S. PATENT DOCUMENTS 9,766,350 B2 * 9/2017 Bando ..... G01S 19/14
2013/0271274 A1 * 10/2013 Ebert ..... E02F 9/2054 340/435
(Continued)

FOREIGN PATENT DOCUMENTS

JP 5570332 B2 8/2014
JP 2019108722 A 7/2019
JP 2019108722 A * 7/2019

OTHER PUBLICATIONS

International Search Report of PCT/JP2019/038465 dated Dec. 17, 2019.

*Primary Examiner* — Babar Sarwar
(74) *Attorney, Agent, or Firm* — MATTINGLY & MALUR, PC

(57) ABSTRACT

Provided is a work machine that can suppress decrease in work efficiency while reducing the possibility of contacting a worker or a dump truck, etc. A movement range is set in advance so as to avoid entry of a worker or a dump truck, etc. into the set movement range. The work machine performs stop control with clearance for an obstacle having entered the movement range, but performs stop control with relatively small clearance (minimum clearance) for a movement range. Thus, the work machine can reduce the frequency of stopping a body or a work implement and
(Continued)

suppress decrease in work efficiency. Since the work machine controls the body or the work implement to stop with clearance when the worker or the dump truck, etc. enters the movement range of the work machine, the work machine can reduce the possibility of contacting the worker or the dump truck, etc.

7 Claims, 16 Drawing Sheets

(51) Int. Cl.

| | |
|---|---|
| ***E02F 9/12*** | (2006.01) |
| ***E02F 9/20*** | (2006.01) |
| ***E02F 9/22*** | (2006.01) |
| ***E02F 9/24*** | (2006.01) |

(52) U.S. Cl.
CPC ..... *E02F 9/24* (2013.01); *E02F 9/2203* (2013.01); *E02F 9/2271* (2013.01); *E02F 9/2285* (2013.01); *E02F 9/2292* (2013.01); *E02F 9/2296* (2013.01)

(58) Field of Classification Search
CPC ..... E02F 9/2285; E02F 9/2292; E02F 9/2296; E02F 9/24; E02F 9/262
See application file for complete search history.

(56) References Cited

U.S. PATENT DOCUMENTS

| | | | | |
|---|---|---|---|---|
| 2018/0173221 | A1* | 6/2018 | Samaraweera | G05D 1/0291 |
| 2020/0071912 | A1* | 3/2020 | Kennedy | G06V 20/17 |
| 2021/0271248 | A1* | 9/2021 | Stander | G05D 1/0214 |
| 2021/0293001 | A1* | 9/2021 | Bares | E02F 9/265 |
| 2022/0162911 | A1* | 5/2022 | Pesola | E21B 7/025 |

* cited by examiner

WORK MACHINE HAVING A MOVABLE BODY OR A MOVABLY MOUNTED WORK IMPLEMENT AND A CONTROL UNIT CONFIGURED TO CALCULATE CLEARANCE AMOUNTS AND COMPARING THEM TO THRESHOLDS

TECHNICAL FIELD

The present invention relates to work machines, such as a hydraulic excavator, a bulldozer, a wheel loader, a compaction machine, a truck, and the like.

BACKGROUND ART

There is known a work machine that controls an attachment to stop turning when there is a high possibility that an approaching object having entered a work area, such as a worker or a dump truck, comes into contact with the attachment of the work machine (for example, Patent Literature 1). The work machine described in Patent Literature 1 starts the turn stop control when an angle interval defined by the orientation of the attachment and the orientation of the approaching object, with the center of turn as a base point, is smaller than a threshold. The threshold of the angle interval is set such that the higher the turning angular velocity, the larger the threshold of the angle interval, or the larger the turning moment of inertia, the larger the threshold of the angle interval.

CITATION LIST

Patent Literature

Patent Literature 1: JP 5570332 B

SUMMARY OF INVENTION

Technical Problem

As in the method described in Patent Literature 1, however, when the work machine performs the stop control with respect to the approaching object, which is movable, the work machine needs to start the turn stop control with some clearance in order to reduce the possibility of contacting the approaching object. In this case, the work machine may perform the stop control even when there is actually no possibility of contacting the approaching object. This may increase the frequency of stopping the work machine in the work area, thus leading to a lower work efficiency.

It is an object of the present invention to provide a work machine that can suppress decrease in work efficiency while reducing the possibility of contacting a worker or a dump truck, for example.

Solution to Problem

In view of the foregoing, according to one aspect of the present invention, a work machine includes a movable body or a work implement movably mounted on a body; an actuator adapted to drive the work implement or the body; a movement range setting unit adapted to set a movement range of the work implement or the body; an obstacle position detection unit adapted to detect a position of an obstacle in vicinity; and a control unit adapted to control the actuator, in which the control unit includes: a first control command calculation unit adapted to calculate a first control command to control the actuator based on the movement range; a second control command calculation unit adapted to calculate a second control command to control the actuator based on a position of the obstacle inside of the movement range; and a control execution unit adapted to perform control of the actuator by selecting, from the first control command and the second control command, a control command that stops the work implement or the body at earlier timing or a control command that more rapidly decelerates the work implement or the body.

Advantageous Effects of Invention

According to the present invention, it is possible to suppress decrease in work efficiency while reducing the possibility of contacting a worker or a dump truck, for example.

DESCRIPTION OF EMBODIMENTS

Figure 1:
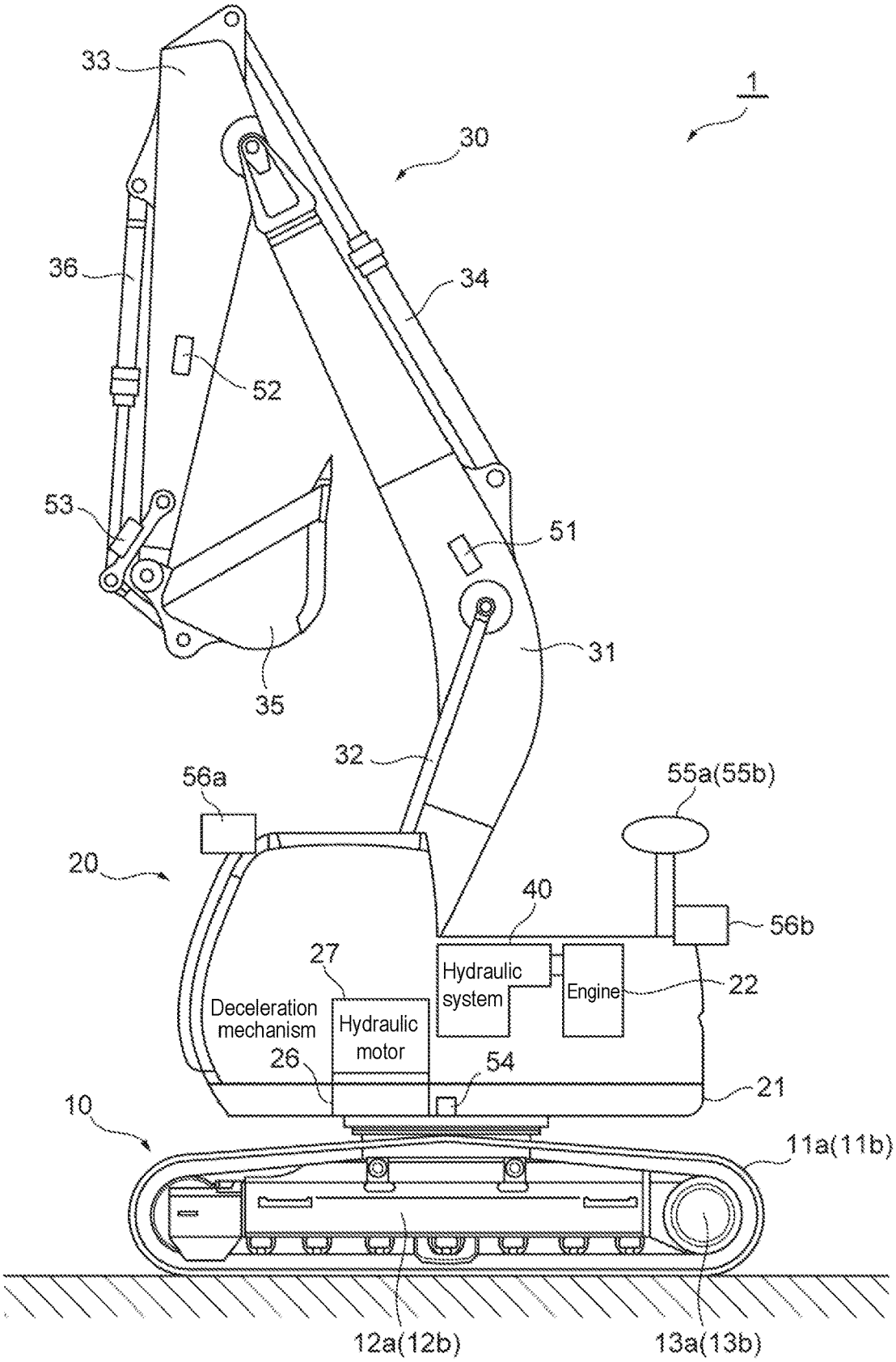
FIG. 1 is a side view of a hydraulic excavator that is one example of the work machine according to a first embodiment of the present invention.

Hereinafter, embodiments of the work machine of the present invention with an example of a hydraulic excavator will be described. It should be noted that the present invention is applicable to general work machines such as bulldozers, wheel loaders, compaction machines, trucks, and the like, and is not limited to the hydraulic excavators.

In the embodiments to be described hereinbelow, components with the same function are denoted by the same or relevant reference numerals and repeated description thereof will be omitted.

First Embodiment

First, a first embodiment of the present invention will be described.

<Overall Configuration>

FIG. 1 is a side view of a hydraulic excavator that is one example of the work machine according to the first embodiment of the present invention. In FIG. 1, a hydraulic excavator 1 includes a crawler-type self-propelled traveling body 10, a turning body 20 provided on the traveling body 10 so as to turn, and a front work implement 30 mounted on the turning body 20 so as to be movable for being raised or lowered. It should be noted that the terms "work machine," "work implement," and "body" in the claims correspond to the hydraulic excavator 1, the front work implement 30, and the traveling body 10 and turning body 20, respectively.

The traveling body 10 includes a pair of crawlers 11*a*, 11*b* and a pair of crawler frames 12*a*, 12*b* (FIG. 1 is a view from only one side thereof), a pair of hydraulic motors for traveling 13*a*, 13*b* adapted to independently drive and control the crawlers 11*a*, 11*b*, and a deceleration mechanism thereof, for example. The driving force of the hydraulic motors for traveling 13*a*, 13*b* serving as actuators is transmitted to the crawlers 11*a*, 11*b* via the deceleration mechanism, for example, to allow the hydraulic excavator 1 (or the traveling body 10 thereof) to travel (move) in a work area (i.e., movement range, which will be described later).

The turning body 20 includes a turning frame 21, an engine 22 as a prime mover provided on the turning frame 21, a hydraulic motor for turning 27, and a deceleration mechanism 26 adapted to decelerate the rotation of the hydraulic motor for turning 27, for example. The driving force of the hydraulic motor for turning 27 serving as an actuator is transmitted to the traveling body 10 via the deceleration mechanism 26 to allow the turning body 20 (i.e., turning frame 21) on the upper side to turn relative to the traveling body 10 on the lower side.

The front work implement 30 is mounted on the turning body 20. The front work implement 30 includes a boom 31, a boom cylinder 32 for driving the boom 31, an arm 33 rotatably supported in the vicinity of the end of the boom 31, an arm cylinder 34 for driving the arm 33, a bucket 35 rotatably supported at the end of the arm 33, and a bucket cylinder 36 for driving the bucket 35, for example. The driving force of the boom cylinder 32, the arm cylinder 34, and the bucket cylinder 36 serving as actuators allows the front work implement 30 (i.e., boom 31, arm 33, and bucket 35) to move relative to the turning body 20 (i.e., turning frame 21).

Furthermore, a hydraulic system 40 for driving the above-described hydraulic actuators, such as the hydraulic motors for traveling 13*a*, 13*b*, the hydraulic motor for turning 27, the boom cylinder 32, the arm cylinder 34, and the bucket cylinder 36, is mounted on the turning frame 21 of the turning body 20. It should be noted that in the following description, the hydraulic motors for traveling 13*a*, 13*b*, the hydraulic motor for turning 27, the boom cylinder 32, the arm cylinder 34, and the bucket cylinder 36 may also be referred to as the hydraulic actuators 13*a*, 13*b*, 27, 32, 34, 36.

The hydraulic system 40 includes hydraulic oil tanks, hydraulic pumps, regulators, a control valve, and the like, which will be described later with reference to FIG. 2.

The front work implement 30 is provided with sensors, such as a boom inclination angle sensor 51, an arm inclination angle sensor 52, and a bucket inclination angle sensor 53. A turning angle sensor 54, GNSS receivers 55*a*, 55*b* (FIG. 1 is a view from only one side thereof), and obstacle position detection units 56*a*, 56*b* are mounted on the turning frame 21 of the turning body 20.

The boom inclination angle sensor 51 is adapted to detect an inclination angle of the boom 31 relative to the ground. The arm inclination angle sensor 52 is adapted to detect an inclination angle of the arm 33 relative to the ground. The bucket inclination angle sensor 53 is adapted to detect an inclination angle of the bucket 35 relative to the ground. These inclination angle sensors 51, 52, 53 may be inertial measurement units (IMUs). In this case, the inclination angle sensors 51, 52, 53 can correct the influence of acceleration and deceleration during the movement of the boom 31, the arm 33, and the bucket 35 and measure accurate inclination angles.

The turning angle sensor 54 is an angle sensor using the electrical resistance or magnetism and is adapted to detect a relative angle between the traveling body 10 and the turning body 20.

The GNSS receivers 55*a*, 55*b* include an antenna and a receiver and are adapted to detect the position (i.e., horizontal coordinate and height) of the GNSS receivers 55*a*, 55*b* relative to the earth. It should be noted that GNSS (global navigation satellite system) is a general term for positioning systems that use satellites.

The obstacle position detection units 56*a*, 56*b* include a camera and a radar and are adapted to detect the position of an obstacle in the vicinity of the hydraulic excavator 1 relative to the turning body 20, such as a worker or a dump truck, for example, which the hydraulic excavator 1 should not come into contact with. It should be noted that in FIG. 1, two obstacle position detection units are mounted on the turning body 20 (i.e., turning frame 21) on its front and rear sides. However, the obstacle position detection units may be mounted on any positions, and the number of obstacle position detection units may be one or three or more.

<System Configuration>

Figure 2:
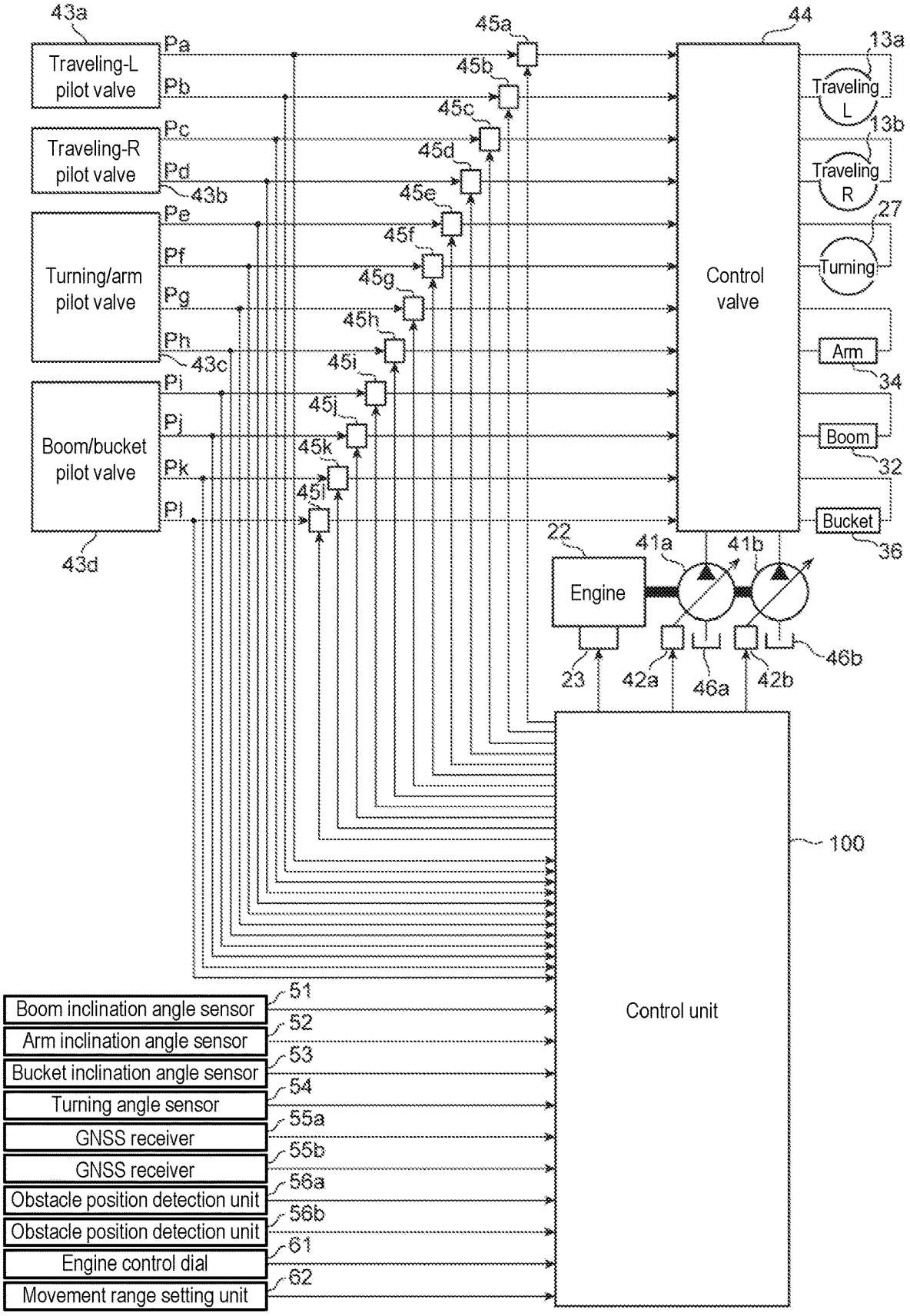
FIG. 2 is a system configuration diagram of the hydraulic excavator that is one example of the work machine according to the first embodiment of the present invention.

FIG. 2 is a system configuration diagram of the hydraulic excavator that is one example of the work machine according to the first embodiment of the present invention. As illustrated in FIG. 2, this system includes an engine 22, an engine controller 23, hydraulic motors for traveling 13*a*, 13*b*, a hydraulic motor for turning 27, a boom cylinder 32, an arm cylinder 34, a bucket cylinder 36, hydraulic oil tanks 46*a*, 46*b*, hydraulic pumps 41*a*, 41*b*, regulators 42*a*, 42*b* thereof, pilot valves 43*a* to 43*d*, a control valve 44, pilot pressure control solenoid valves 45*a* to 451, a boom inclination angle sensor 51, an arm inclination angle sensor 52, a bucket inclination angle sensor 53, a turning angle sensor 54, GNSS receivers 55*a*, 55*b*, obstacle position detection units 56*a*, 56*b*, an engine control dial 61, a movement range setting unit 62, and a control unit 100.

The engine 22 is controlled by the engine controller 23. The engine controller 23 is adapted to adjust a fuel injection amount and a fuel injection timing of the engine 22 so that a target value of an engine revolution speed outputted from the control unit 100 matches with an actual engine revolution speed.

The hydraulic pumps 41*a*, 41*b* are variable capacity hydraulic pumps and are driven by the engine 22 to rotate so as to eject (from the hydraulic oil tanks 46*a*, 46*b* to the hydraulic actuators 13*a*, 13*b*, 27, 32, 34, 36 via the control valve 44) hydraulic oil in an amount proportional to the product of the revolution speed and the capacity.

The regulators 42*a*, 42*b* are driven according to control commands from the control unit 100 and are adapted to change the capacities of the hydraulic pumps 41*a*, 41*b*.

A traveling-L pilot valve 43*a* is adapted to generate a forward-traveling-L pilot pressure Pa and a backward-traveling-L pilot pressure Pb according to the inclination of the corresponding control lever (not illustrated) in the front-rear direction. A traveling-R pilot valve 43*b* is adapted to generate a forward-traveling-R pilot pressure Pc and a backward-traveling-R pilot pressure Pd according to the inclination of the corresponding control lever (not illustrated) in the front-rear direction. A turning/arm pilot valve 43*c* is adapted to generate a rightward-turning pilot pressure Pe, a leftward-turning pilot pressure Pf, an arm-dumping pilot pressure Pg, and an arm-crowding pilot pressure Ph according to the inclination of the corresponding control lever (not illustrated) in the front-rear direction and the right-left direction. A boom/bucket pilot valve 43*d* is adapted to generate a boom-lowering pilot pressure Pi, a boom-raising pilot pressure Pj, a bucket-crowding pilot pressure Pk, and a bucket-dumping pilot pressure Pl according to the inclination of the corresponding control lever (not illustrated) in the front-rear direction and the right-left direction. It should be noted that the pilot valves 43*a* to 43*d* may generate pilot pressures Pa to Pl when the operator controls the corresponding control levers provided in the operator seat of the hydraulic excavator 1, as described above, for example, or may generate pilot pressures Pa to Pl according to the control commands from the control unit 100 even when the operator does not control the control levers, as in the automatic operation.

The control valve 44 is driven in response to the pilot pressures Pa to Pl corresponding to the hydraulic actuators 13*a*, 13*b*, 27, 32, 34, 36, respectively, and is adapted to adjust the flow rate of the hydraulic oil flowing from the hydraulic pumps 41*a*, 41*b* to the hydraulic actuators 13*a*, 13*b*, 27, 32, 34, 36 and the flow rate of the hydraulic oil flowing from the hydraulic actuators 13*a*, 13*b*, 27, 32, 34, 36 to the hydraulic oil tanks 46*a*, 46*b*.

The pilot pressure control solenoid valves 45*a* to 451 are adapted to limit the pilot pressures Pa to Pl according to the control commands from the control unit 100 (i.e., reduce the pilot pressure to the limit when the pilot pressure is higher than or equal to the limit or leave it as it is when the pilot pressure is lower than or equal to the limit) to decelerate or stop the hydraulic actuators 13*a*, 13*b*, 27, 32, 34, 36, which will be described later.

The engine control dial 61 is a means located in the operator seat of the hydraulic excavator 1 so that the operator sends an instruction of the engine revolution speed, for example. When the operator turns the engine control dial 61, the output voltage changes according to the angle of the dial.

The movement range setting unit 62 is adapted to set a movement range (i.e., work area) of the present hydraulic excavator 1 and output the information to the control unit 100. The term "movement range" means a range in which the traveling body 10, the turning body 20, and the front work implement 30 move along with the traveling and turning of the hydraulic excavator 1 and the work of the hydraulic excavator 1 using the front work implement 30 in an upcoming work. It should be noted that the movement range setting unit 62 may be located in the operator seat of the hydraulic excavator 1 so that the operator may perform control and setting to send information to the control unit 100, or the movement range setting unit 62 may be located outside of the hydraulic excavator 1 so that information is wirelessly sent to the control unit 100.

The control unit 100 is adapted to output a target value of the engine revolution speed to the engine controller 23 on the basis of the output voltage of the engine control dial 61. Further, the control unit 100 is adapted to detect the pilot pressures Pa to Pl by sensors, and on the basis of the detection values and command values of the pilot pressure control solenoid valves 45*a* to 45*l* , control the regulators 42*a*, 42*b* to secure the flow rate of the hydraulic oil flowing to the hydraulic actuators 13*a*, 13*b*, 27, 32, 34, 36.

In addition, as will be described later, the control unit 100 is adapted to control the pilot pressure control solenoid valves 45*a* to 451 so as to decelerate or stop the hydraulic actuators 13*a*, 13*b*, 27, 32, 34, 36. A method for controlling the pilot pressure control solenoid valves 45*a* to 45*l* will be described with reference to FIG. 3 and the like.

<Functional Block Configuration and Control Contents of Control Unit>

Figure 3:
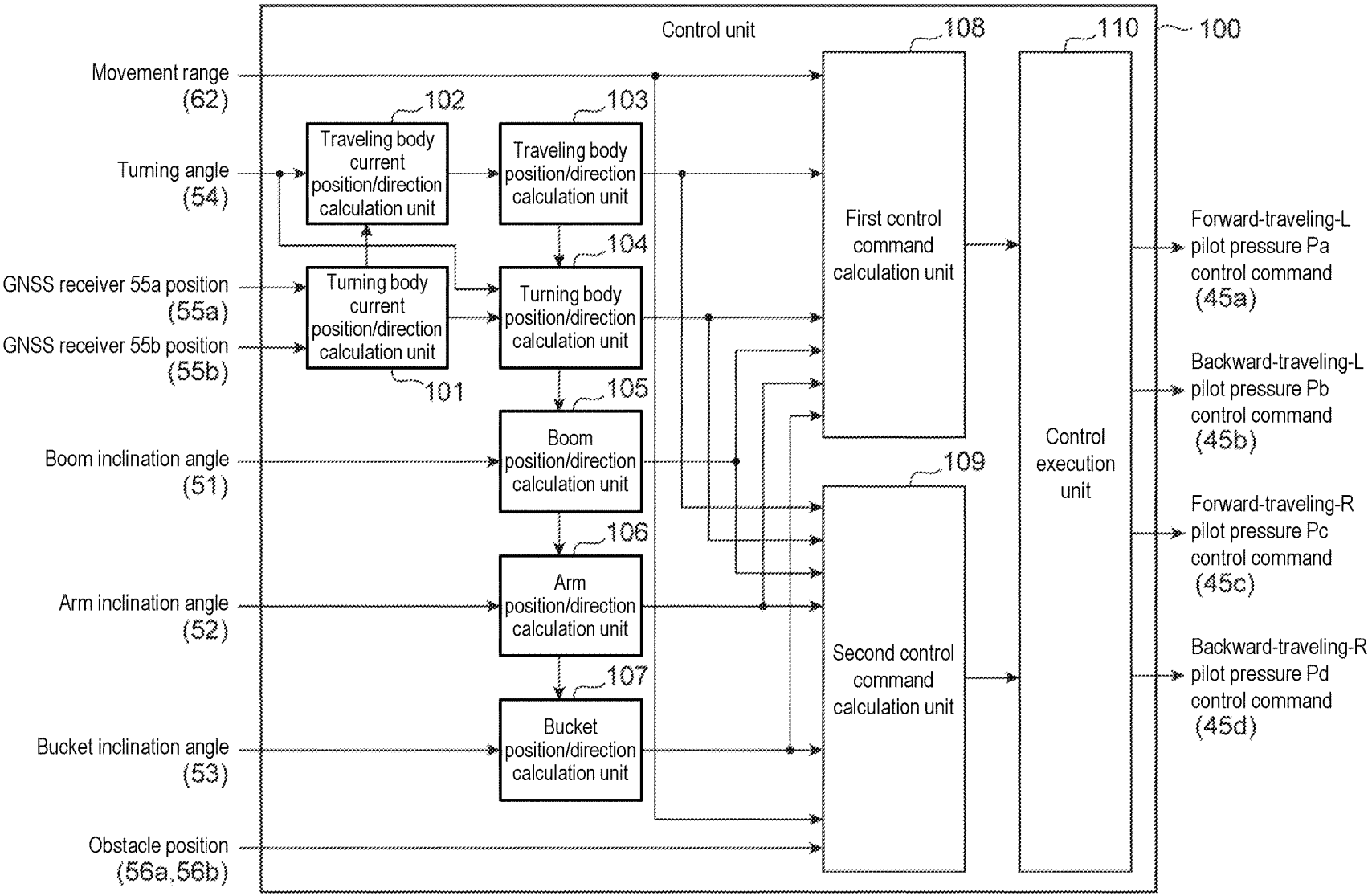
FIG. 3 is a functional block diagram of a control unit of the first embodiment of the present invention.

FIG. 3 is a functional block diagram of the control unit 100 of the first embodiment of the present invention. FIG. 3 illustrates one example of the method for controlling the pilot pressure control solenoid valves 45*a* to 451 performed by the control unit 100, particularly one example of the method for controlling the pilot pressure control solenoid valves 45*a* to 45*d* that control the pilot pressures Pa to Pd associated with traveling, among the pilot pressure control solenoid valves 45*a* to 45*l*.

Though not illustrated in the drawings, the control unit 100 is constituted of a microcomputer including a CPU that performs various kinds of operations, a storage device such as ROM or HDD that stores programs for execution of the operations by the CPU, RAM that serves as a work area in the execution of programs by the CPU, a communication interface (i.e., communication I/F) that serves as an interface in exchanging data with the other units, for example. The functions of the control unit 100 are implemented according to various programs stored in the storage device, which are loaded onto the RAM and executed by the CPU.

In the control unit 100, a turning body current position/direction calculation unit 101 is adapted to calculate and output a position of the center of turn of the turning body 20 and a direction (i.e., orientation) of the turning body 20 on the basis of the position of the GNSS receiver 55*a* and the position of the GNSS receiver 55*b* detected by the GNSS receivers 55*a*, 55*b*.

A traveling body current position/direction calculation unit 102 is adapted to output a value that is equal to the position of the turning body 20 calculated in the turning body current position/direction calculation unit 101 as the position of the traveling body 10. Further, the traveling body current position/direction calculation unit 102 is adapted to calculate and output a direction of the traveling body 10 on the basis of the direction of the turning body 20 calculated in the turning body current position/direction calculation unit 101 and the turning angle (i.e., relative angle between the traveling body 10 and the turning body 20) detected by the turning angle sensor 54.

A traveling body position/direction calculation unit 103 is adapted to calculate a future position and direction of the traveling body 10 in the traveling at a maximum speed on the basis of the current position and direction of the traveling body 10 received from the traveling body current position/direction calculation unit 102. For example, the traveling body position/direction calculation unit 103 calculates positions of the traveling body 10 after a lapse of 0.1 seconds, 0.2 seconds, 0.3 seconds, . . . , 2.0 seconds in the forward traveling at a maximum speed and positions of the traveling body 10 after a lapse of 0.1 seconds, 0.2 seconds, 0.3 seconds, . . . , 2.0 seconds in the backward traveling at a maximum speed. Suppose that the future direction is equal to the current direction. It should be noted that when the traveling body 10 is currently traveling, the traveling body position/direction calculation unit 103 may calculate positions and directions of the traveling body 10 after a lapse of 0.1 seconds, 0.2 seconds, 0.3 seconds, . . . , 2.0 seconds in the traveling while keeping its path. The traveling body position/direction calculation unit 103 is adapted to output altogether information on the future position and direction of the traveling body 10 calculated in the traveling body position/direction calculation unit 103 and information on the current position and direction of the traveling body 10 calculated in the traveling body current position/direction calculation unit 102.

A turning body position/direction calculation unit 104 is adapted to output a value that is equal to the future position of the traveling body 10 calculated in the traveling body position/direction calculation unit 103 as the future position of the turning body 20. Further, the turning body position/direction calculation unit 104 is adapted to calculate a future direction of the turning body 20 (suppose that the future turning angle is equal to the current turning angle) on the basis of the future direction of the traveling body 10 calculated in the traveling body position/direction calculation unit 103 and the turning angle (i.e., relative angle between the traveling body 10 and the turning body 20) detected by the turning angle sensor 54. The turning body position/direction calculation unit 104 is adapted to output altogether information on the future position and direction of the turning body 20 calculated in the turning body position/direction calculation unit 104 and information on the current position and direction of the turning body 20 calculated in the turning body current position/direction calculation unit 101.

A boom position/direction calculation unit 105 is adapted to calculate current and future positions of the coupling portion of the boom 31 that is coupled to the turning body 20 on the basis of the current and future positions and directions of the turning body 20 received from the turning body position/direction calculation unit 104, calculate current and future positions of the coupling portion of the boom 31 that is coupled to the arm 33 on the basis of the calculated value of the current and future positions of the coupling portion of the boom 31 that is coupled to the turning body 20 and the inclination angle of the boom 31 detected by the boom inclination angle sensor 51, and output the calculated value of the current and future positions of the coupling portion of the boom 31 that is coupled to the arm 33 as the current and future positions of the boom 31. Further, the boom position/direction calculation unit 105 is adapted to output a value that is equal to the current and future directions of the turning body 20 received from the turning body position/direction calculation unit 104 as the current and future directions of the boom 31.

An arm position/direction calculation unit 106 is adapted to calculate current and future positions of the coupling portion of the arm 33 that is coupled to the bucket 35 on the basis of the current and future positions and directions of the boom 31 received from the boom position/direction calculation unit 105 and the inclination angle of the arm 33 detected by the arm inclination angle sensor 52, and output the calculated value as the current and future positions of the arm 33. Further, the arm position/direction calculation unit 106 is adapted to output a value that is equal to the current and future directions of the boom 31 received from the boom position/direction calculation unit 105 as the current and future directions of the arm 33.

A bucket position/direction calculation unit 107 is adapted to calculate current and future positions of the end of the bucket 35 on the basis of the current and future positions and directions of the arm 33 received from the arm position/direction calculation unit 106 and the inclination angle of the bucket 35 detected by the bucket inclination angle sensor 53, and output the calculated value as the current and future positions of the bucket 35. Further, the bucket position/direction calculation unit 107 is adapted to output a value that is equal to the current and future directions of the arm 33 received from the arm position/direction calculation unit 106 as the current and future directions of the bucket 35.

A first control command calculation unit 108 is adapted to calculate a first control command to control the hydraulic actuators 13*a*, 13*b*, 27, 32, 34, 36 basically based on the movement range set in the movement range setting unit 62, with inputs of the information outputted from the aforementioned calculation units 103 to 107 and the information on the movement range set in the movement range setting unit 62.

Figure 4:
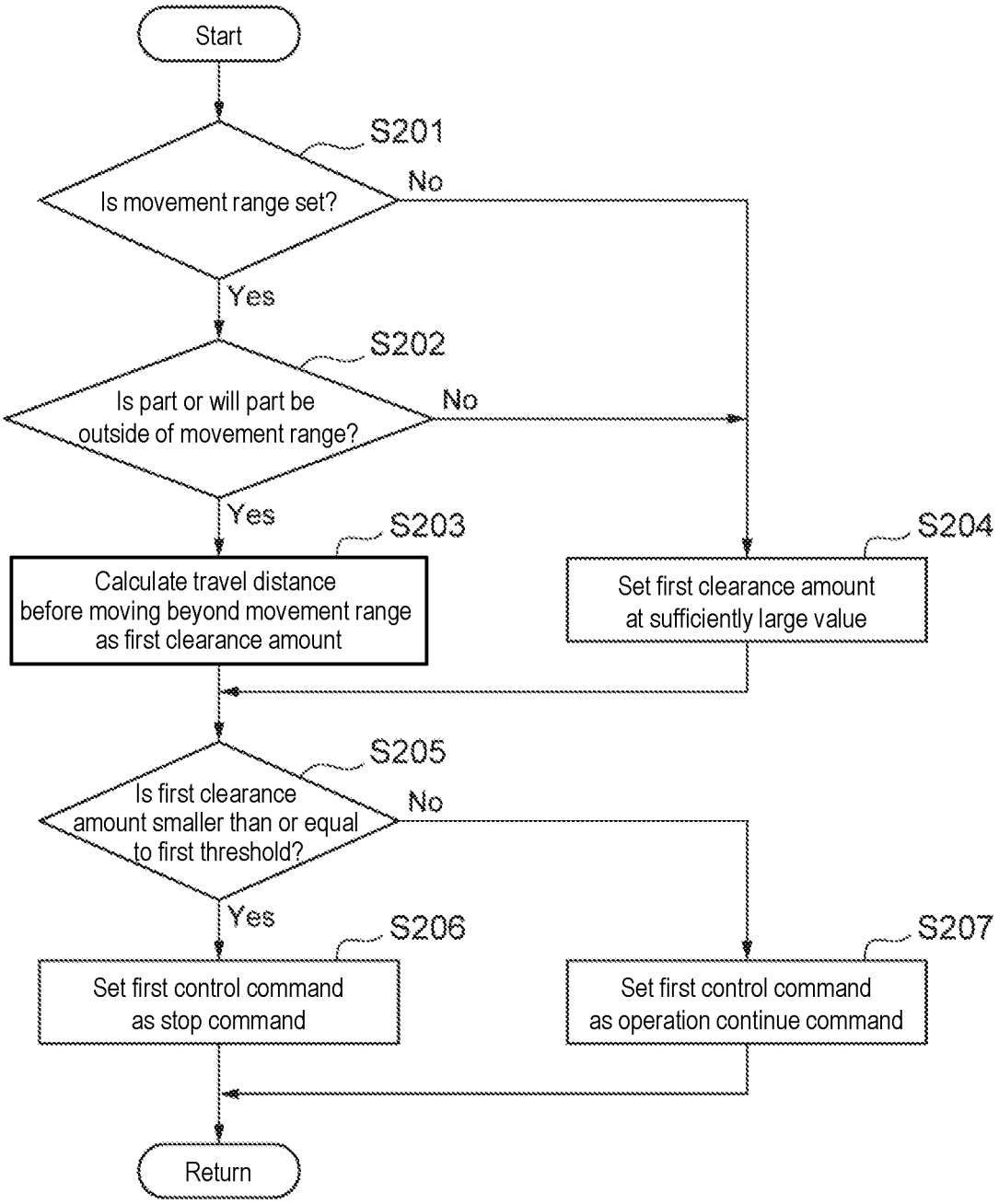
FIG. 4 is a flowchart showing the calculation process of a first control command calculation unit of the control unit according to the first embodiment of the present invention.

The first control command calculation unit 108 performs the calculation illustrated in the flowchart of FIG. 4. First, the first control command calculation unit 108 determines whether a movement range is set in the movement range setting unit 62 (S201). If a movement range is set (S201: Yes), the first control command calculation unit 108 determines whether a part of the traveling body 10, the turning body 20, the boom 31, the arm 33, and the bucket 35 is or is expected to be outside of the movement range (S202). If a part of the traveling body 10, the turning body 20, the boom 31, the arm 33, and the bucket 35 is or is expected to be outside of the movement range (S202: Yes), the first control command calculation unit 108 calculates a travel distance (i.e., clearance amount) before moving beyond the movement range by multiplying the shortest time period before moving beyond the movement range (the shortest time period is zero when a part of the traveling body 10, the turning body 20, the boom 31, the arm 33, and the bucket 35 is currently outside of the movement range) by the maximum travel speed, and sets the obtained value as a first clearance amount (S203). If a part of the traveling body 10, the turning body 20, the boom 31, the arm 33, and the bucket 35 is not or is not expected to be outside of the movement range (S202: No) or if a movement range is not set (S201: No), a sufficiently large value (i.e., a value larger than a first threshold, which will be described later) is set as a first clearance amount (S204). Then, the first control command calculation unit 108 determines whether the first clearance amount is smaller than or equal to the first threshold (S205). When the first clearance amount is smaller than or equal to the first threshold (S205: Yes), the first control command calculation unit 108 outputs a stop command as a first control command (S206), and when the first clearance amount is larger than the first threshold (S205: No), the first control command calculation unit 108 outputs an operation continue command as a first control command (S207). The first threshold may be a preset fixed value or may be a value that may vary such that the larger the downward inclination, the larger the value in consideration of the fact that the hydraulic excavator 1 is less likely to stop in the downward slope.

Meanwhile, a second control command calculation unit 109 is adapted to calculate a second control command to control the hydraulic actuators 13*a*, 13*b*, 27, 32, 34, 36 basically based on the position of the obstacle detected in the obstacle position detection units 56*a*, 56*b*, with inputs of the information outputted from the aforementioned calculation units 103 to 107, the information on the movement range set in the movement range setting unit 62, and the information on the position of the obstacle detected in the obstacle position detection units 56*a*, 56*b*.

Figure 5:
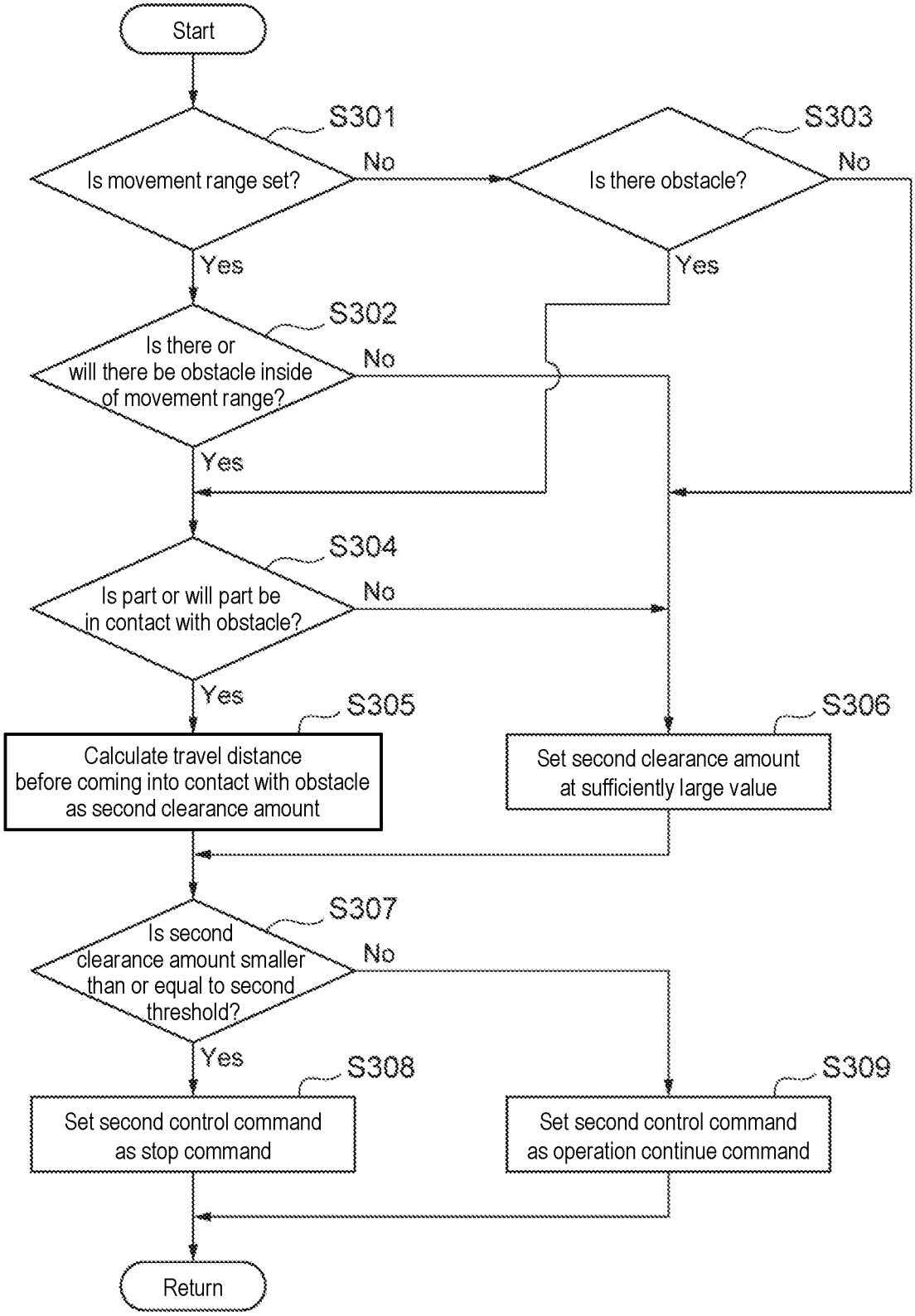
FIG. 5 is a flowchart showing the calculation process of a second control command calculation unit of the control unit according to the first embodiment of the present invention.

The second control command calculation unit 109 performs the calculation illustrated in the flowchart of FIG. 5. First, the second control command calculation unit 109 determines whether a movement range is set in the movement range setting unit 62 (S301). If a movement range is set (S301: Yes), the second control command calculation unit 109 determines whether there is an obstacle inside of the movement range (S302). If a movement range is not set (S301: No), the second control command calculation unit 109 determines whether there is an obstacle regardless of location (S303). If there is an obstacle in S302 or S303 (S302, S303: Yes), the second control command calculation unit 109 determines whether a part of the traveling body 10, the turning body 20, the boom 31, the arm 33, and the bucket 35 is or is expected to be in contact with the obstacle (S304). If a part of the traveling body 10, the turning body 20, the boom 31, the arm 33, and the bucket 35 is or is expected to be in contact with the obstacle (S304: Yes), the second control command calculation unit 109 calculates a travel distance (i.e., clearance amount) before coming into contact with the obstacle by multiplying the shortest time period before coming into contact with the obstacle (the shortest time period is zero when a part of the traveling body 10, the turning body 20, the boom 31, the arm 33, and the bucket 35 is currently in contact with the obstacle) by the maximum travel speed, and sets the obtained value as a second clearance amount (S305). If a part of the traveling body 10, the turning body 20, the boom 31, the arm 33, and the bucket 35 is not or is not expected to be in contact with the obstacle (S304: No) or if there is no obstacle in S302 or S303 (S302, S303: No), a sufficiently large value (i.e., a value larger than a second threshold, which will be described later) is set as a second clearance amount (S306). Then, the second control command calculation unit 109 determines whether the second clearance amount is smaller than or equal to the second threshold (S307). When the second clearance amount is smaller than or equal to the second threshold (S307: Yes), the second control command calculation unit 109 outputs a stop command as a second control command (S308), and when the second clearance amount is larger than the second threshold (S307: No), the second control command calculation unit 109 outputs an operation continue command as a second control command (S309). The second threshold may be a preset fixed value or may be a value that may vary such that the larger the downward inclination, the larger the value in consideration of the fact that the hydraulic excavator 1 is less likely to stop in the downward slope.

Since an obstacle such as a worker or a dump truck, for example, may move, the stop control with respect to the obstacle (i.e., obstacle entering the movement range) is preferably performed with a larger clearance (i.e., at earlier timing) than that in the stop control with respect to the movement range.

Then, the second threshold set in the second control command calculation unit 109 is set larger than the first threshold set in the first control command calculation unit 108. In one example, the second threshold is set to 5 m and the first threshold is set to 2 m. In addition, the second threshold set in the second control command calculation unit 109 may be a relatively large value in consideration of errors in the position detected in the obstacle position detection units 56*a*, 56*b*.

Referring back to FIG. 3, when at least one of the first control command received from the first control command calculation unit 108 or the second control command received from the second control command calculation unit 109 is a stop command, a control execution unit 110 selects an appropriate stop command from the first and second control commands, and controls the pilot pressure control solenoid valves 45*a* to 45*d* to cut the forward-traveling-L pilot pressure Pa, the backward-traveling-L pilot pressure Pb, the forward-traveling-R pilot pressure Pc, and the backward-traveling-R pilot pressure Pd (i.e., set them to 0 MPa) acting on the control valve 44 in order to stop traveling (specifically, control the hydraulic motors for traveling 13*a*, 13*b* serving as the hydraulic actuators to stop).

Specifically, when one of the first control command received from the first control command calculation unit 108 or the second control command received from the second control command calculation unit 109 is a stop command, the control execution unit 110 selects the stop command, and controls the pilot pressure control solenoid valves 45*a* to 45*d* as described above.

Meanwhile, when both of the first control command received from the first control command calculation unit 108 and the second control command received from the second control command calculation unit 109 are stop commands, the control execution unit 110 selects, from the first and second control commands, a stop command that stops the traveling at earlier timing (i.e., a stop command that stops the hydraulic motors for traveling 13*a*, 13*b* serving as the hydraulic actuators at earlier timing) and controls the pilot pressure control solenoid valves 45*a* to 45*d* as described above.

At this time, the pilot pressures for the remaining pilot pressure control solenoid valves 45*e* to 45*l* may be cut or may not be cut. Cutting the pilot pressures to stop the pilot pressure control solenoid valves stops all of the actuators as well as traveling, and thus, the operator can easily understand the entire operation of the hydraulic excavator 1. The operation other than traveling is continued unless the pilot pressures are cut, which enhances convenience.

In either case, the above-described travel stop control can reduce the possibility that the body (i.e., the traveling body 10, the turning body 20) or the work implement (i.e., the boom 31, the arm 33, and the bucket 35 of the front work implement 30) moves beyond the set movement range or comes into contact with the detected obstacle.

It should be noted that when both of the first control command received from the first control command calculation unit 108 and the second control command received from the second control command calculation unit 109 are operation continue commands, the control execution unit 110 controls the pilot pressure control solenoid valves 45*a* to 45*d* to maintain the forward-traveling-L pilot pressure Pa, the backward-traveling-L pilot pressure Pb, the forward-traveling-R pilot pressure Pc, and the backward-traveling-R pilot pressure Pd acting on the control valve 44 in order to continue current traveling.

As described above, the hydraulic excavator 1 that is the work machine of the first embodiment includes the movable body (i.e., the traveling body 10, the turning body 20) or the work implement (i.e., the boom 31, the arm 33, and the bucket 35 of the front work implement 30) movably mounted on the body, the actuators (i.e., the hydraulic motors for traveling 13*a*, 13*b*, the hydraulic motor for turning 27, the boom cylinder 32, the arm cylinder 34, and the bucket cylinder 36) adapted to drive the work implement or the body, the movement range setting unit 62 adapted to set the movement range of the work implement or the body, the obstacle position detection units 56*a*, 56*b* adapted to detect the position of the obstacle in the vicinity of the hydraulic excavator 1, and the control unit 100 adapted to control the actuators. The control unit 100 includes the first control command calculation unit 108 adapted to calculate the first control command to control the actuators based on the movement range, the second control command calculation unit 109 adapted to calculate the second control command to control the actuators based on the position of the obstacle inside of the movement range or the position of the obstacle when the movement range is not set, and the control execution unit 110 adapted to perform control of the actuators by selecting, from the first control command and the second control command, a control command that stops the work implement or the body at earlier timing.

In addition, the first control command calculation unit 108 calculates a clearance amount before the work implement or the body moves beyond the movement range and sets the obtained value as a first clearance amount. When the first clearance amount is smaller than or equal to the first threshold, the first control command calculation unit 108 sets the first control command as a stop command, and when the first clearance amount is larger than the first threshold, the first control command calculation unit 108 sets the first control command as an operation continue command. The second control command calculation unit 109 calculates a clearance amount before the work implement or the body comes into contact with the obstacle inside of the movement range or the obstacle when the movement range is not set, and sets the obtained value as a second clearance amount. When the second clearance amount is smaller than or equal to the second threshold, the second control command calculation unit 109 sets the second control command as a stop command, and when the second clearance amount is larger than the second threshold, the second control command calculation unit 109 sets the second control command as an operation continue command. When at least one of the first control command or the second control command is a stop command, the control execution unit 110 controls the actuators to stop. The second threshold is larger than the first threshold.

Here, since the second threshold is larger than the first threshold, the stop control with respect to the obstacle can be performed with a larger clearance (i.e., at earlier timing) than that in the stop control with respect to the movement range.

As described above, according to the first embodiment, the stop control is performed with respect to the obstacle with clearance, whereas the stop control is performed with respect to the movement range with relatively small clearance (i.e., with a minimum clearance). Thus, as long as a movement range is set in advance so as to avoid entry of a worker or a dump truck, for example, into the set movement range, it is possible to reduce the frequency of stopping the body and suppress decrease in work efficiency. Furthermore, since the work machine controls the body to stop with clearance when the worker or the dump truck, for example, enters the movement range of the present work machine, it is possible to reduce the possibility of contacting the worker or the dump truck, for example.

Second Embodiment

Next, a second embodiment of the present invention will be described.

The second embodiment is equal to the first embodiment except that the second control command calculation unit 109 of the control unit 100 performs calculation different from that of the first embodiment.

Figure 6:
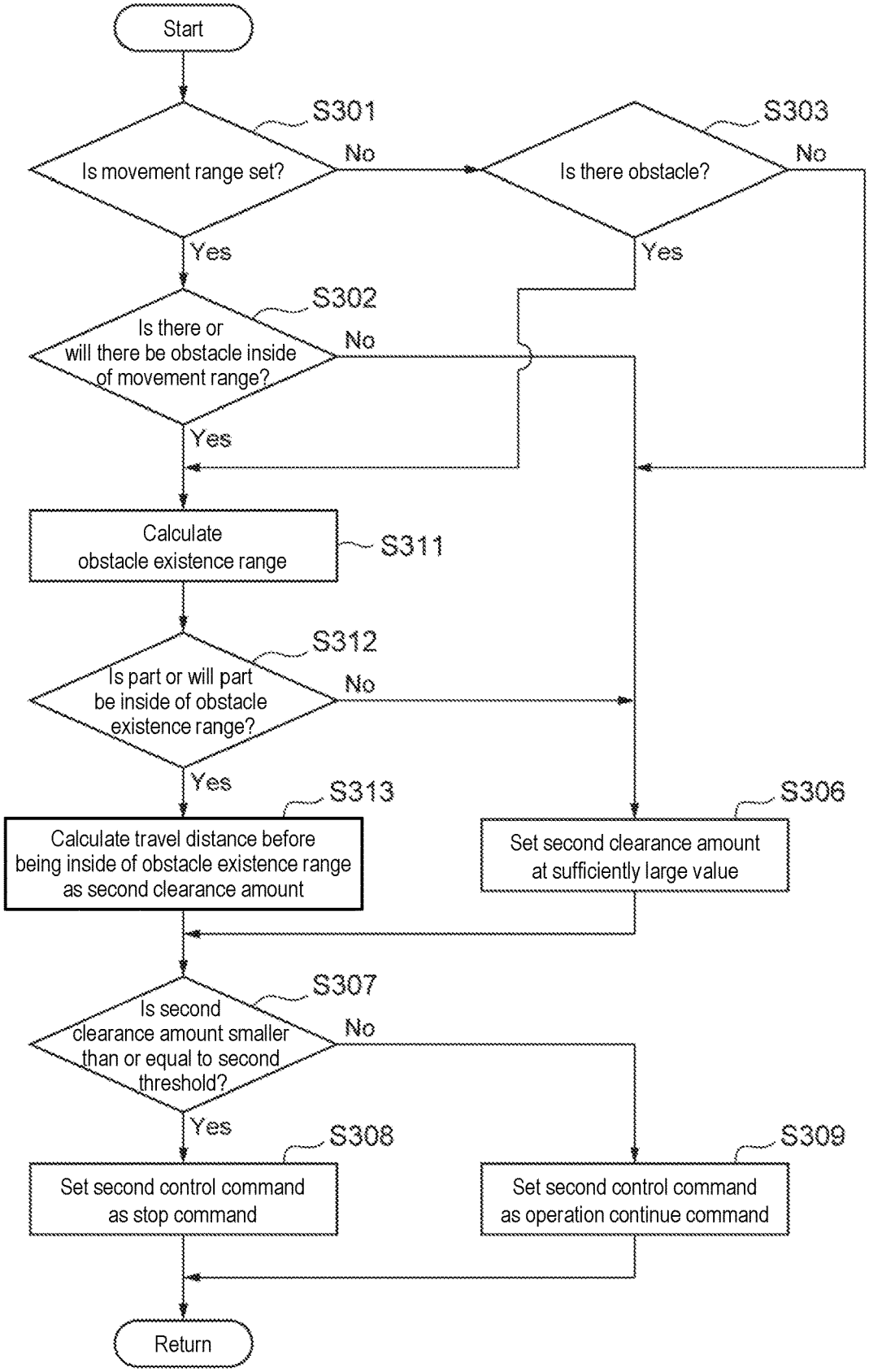
FIG. 6 is a flowchart showing the calculation process of the second control command calculation unit of the control unit according to a second embodiment of the present invention.

The second control command calculation unit 109 of the second embodiment performs the calculation illustrated in the flowchart of FIG. 6. The calculation in S301 to S303, S306 to S309 of FIG. 6 is equal to that of the first embodiment (see FIG. 5). In the second embodiment, if there is an obstacle in S302 or S303 (S302, S303: Yes), a periphery of the obstacle is set as a range having a possibility that an obstacle exists or is expected to exist therein (this range will be referred to as the obstacle existence range) (S311). This range may be a preset fixed value or may be a value that may vary such that the value increases as time passes in consideration of the movement of the obstacle. When the value is set to increase as time passes, the current range and the ranges after a lapse of 0.1 seconds, 0.2 seconds, 0.3 seconds, . . . , 2.0 seconds are set as the obstacle existence ranges. In addition, the obstacle existence range may be a circular area of a few meters in diameter around the obstacle or may be an area that is extended in the moving direction in consideration of the movement of the obstacle. Then, the second control command calculation unit 109 determines whether a part of the traveling body 10, the turning body 20, the boom 31, the arm 33, and the bucket 35 is or is expected to be inside of the obstacle existence range (S312). If a part of the traveling body 10, the turning body 20, the boom 31, the arm 33, and the bucket 35 is or is expected to be inside of the obstacle existence range (S312: Yes), the second control command calculation unit 109 calculates a travel distance (i.e., clearance amount) before being inside of the obstacle existence range by multiplying a time period before being inside of the obstacle existence range (the time period is zero when a part of the traveling body 10, the turning body 20, the boom 31, the arm 33, and the bucket 35 is currently inside of the obstacle existence range) by the maximum travel speed, and sets the obtained value as a second clearance amount (S313).

In the second embodiment, since the stop control is performed with respect to the obstacle existence range that is set to the periphery of the obstacle, the stop control with respect to the obstacle itself is performed with clearance. Thus, unlike the first embodiment, the second threshold set in the second control command calculation unit 109 need not be larger than the first threshold set in the first control command calculation unit 108. In one example, the second threshold may be set to a value equal to the first threshold (for example, 2 m).

As described above, in the second embodiment, the first control command calculation unit 108 calculates a clearance amount before the work implement or the body moves beyond the movement range and sets the obtained value as a first clearance amount. When the first clearance amount is smaller than or equal to the first threshold, the first control command calculation unit 108 sets the first control command as a stop command, and when the first clearance amount is larger than the first threshold, the first control command calculation unit 108 sets the first control command as an operation continue command. The second control command calculation unit 109 sets, as an obstacle existence range, a periphery of the obstacle inside of the movement range or a periphery of the obstacle when the movement range is not set, calculates a clearance amount before the work implement or the body enters the obstacle existence range, and sets the obtained value as a second clearance amount. When the second clearance amount is smaller than or equal to the second threshold, the second control command calculation unit 109 sets the second control command as a stop command, and when the second clearance amount is larger than the second threshold, the second control command calculation unit 109 sets the second control command as an operation continue command. When at least one of the first control command or the second control command is a stop command, the control execution unit 110 controls the actuators to stop.

As described above, also in the second embodiment, the stop control is performed with respect to the obstacle with clearance, whereas the stop control is performed with respect to the movement range with relatively small clearance (i.e., with a minimum clearance). Thus, as long as a movement range is set in advance so as to avoid entry of a worker or a dump truck, for example, into the set movement range, it is possible to reduce the frequency of stopping the body and suppress decrease in work efficiency. Furthermore, since the work machine controls the body to stop with clearance when the worker or the dump truck, for example, enters the movement range of the present work machine, it is possible to reduce the possibility of contacting the worker or the dump truck, for example.

Third Embodiment

Next, a third embodiment of the present invention will be described.

The third embodiment is equal to the first embodiment except that the first control command calculation unit 108, the second control command calculation unit 109, and the control execution unit 110 of the control unit 100 perform calculation different from that of the first embodiment.

Figure 7:
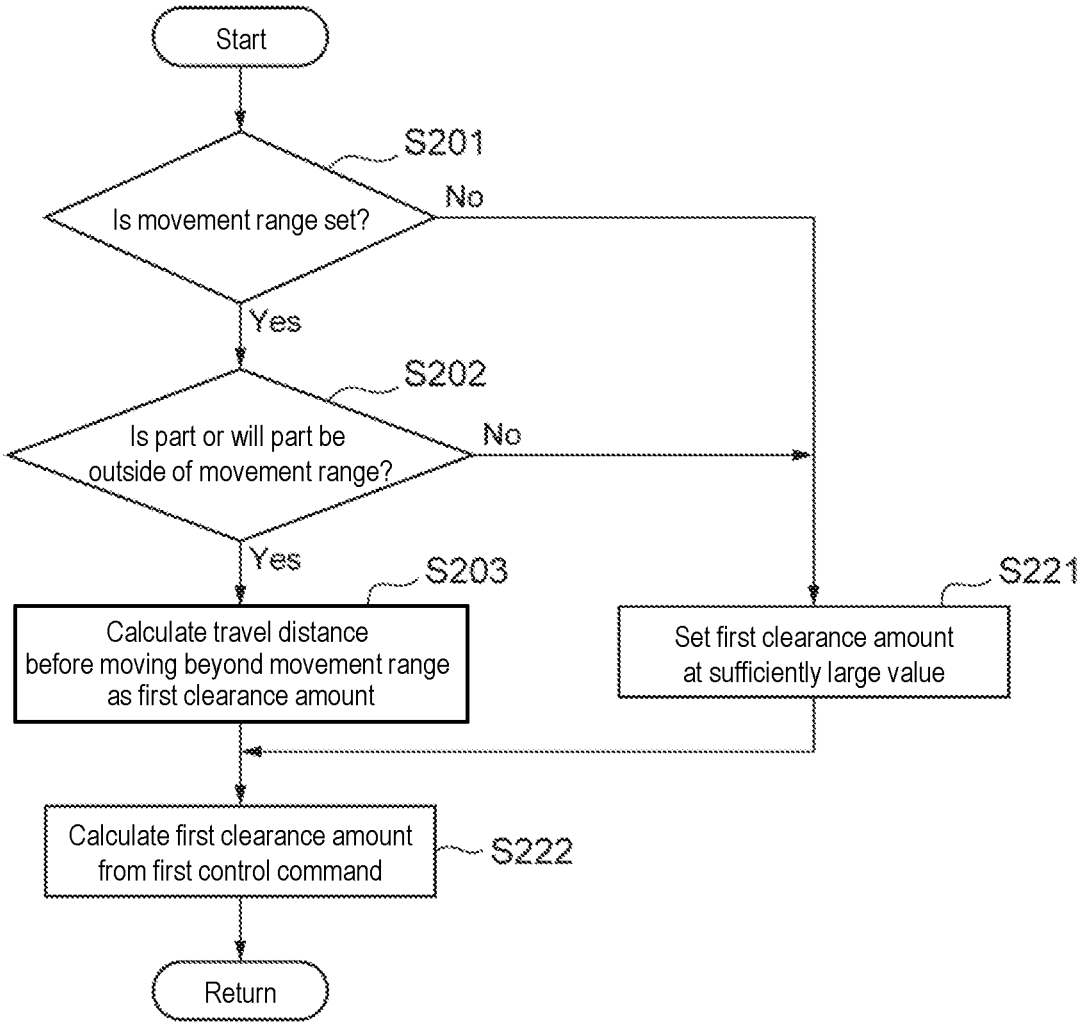
FIG. 7 is a flowchart showing the calculation process of the first control command calculation unit of the control unit according to a third embodiment of the present invention.

The first control command calculation unit 108 of the third embodiment performs the calculation illustrated in the flowchart of FIG. 7. The calculation in S201 to S203 of FIG. 7 is equal to that of the first embodiment (see FIG. 4). In the third embodiment, if a part of the traveling body 10, the turning body 20, the boom 31, the arm 33, and the bucket 35 is not or is not expected to be outside of the movement range (S202: No) or if a movement range is not set in the movement range setting unit 62 (S201: No), a sufficiently larger value than a clearance amount X1, which corresponds to a first speed limit value of the maximum speed in FIG. 9 (described later), is set as a first clearance amount (S221). Then, the first control command calculation unit 108 calculates a first speed limit value from the first clearance amount using FIG. 9 and outputs the obtained value as a first control command (S222).

Figure 9:
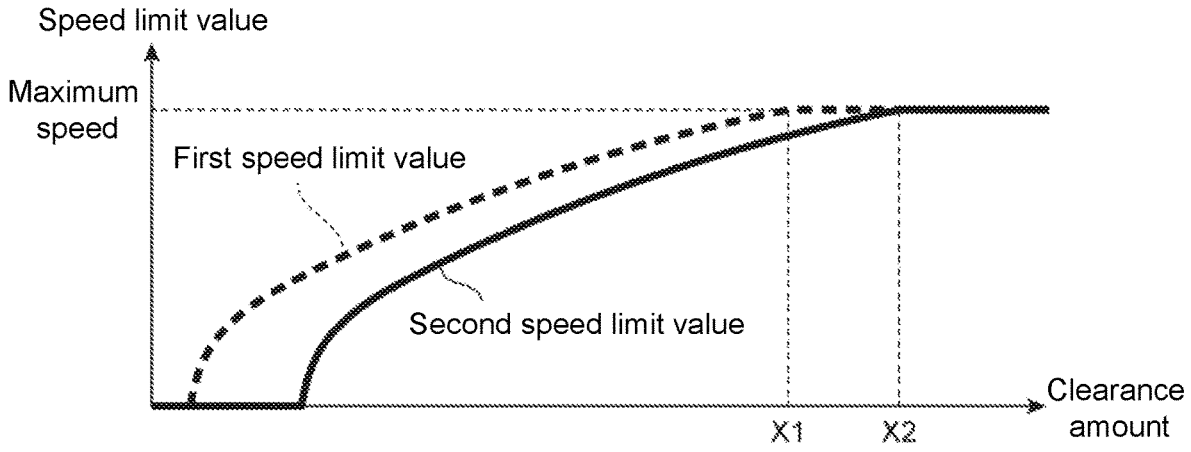
FIG. 9 is a graph showing an example of a first speed limit value used in the first control command calculation unit and a second speed limit value used in the second control command calculation unit of the control unit according to the third embodiment of the present invention.

The first speed limit value of FIG. 9 is a speed limit value (i.e., upper speed limit) for controlling the hydraulic actuators 13*a*, 13*b*, 27, 32, 34, 36 to decelerate and stop, and is set such that the larger the first clearance amount, the larger the first speed limit value (in other words, the smaller the first clearance amount, the smaller the first speed limit value). The value in FIG. 9 may be a preset fixed value or may be a value that may vary such that the larger the downward inclination, the smaller the value in consideration of the fact that the hydraulic excavator 1 is less likely to stop in the downward slope.

Figure 8:
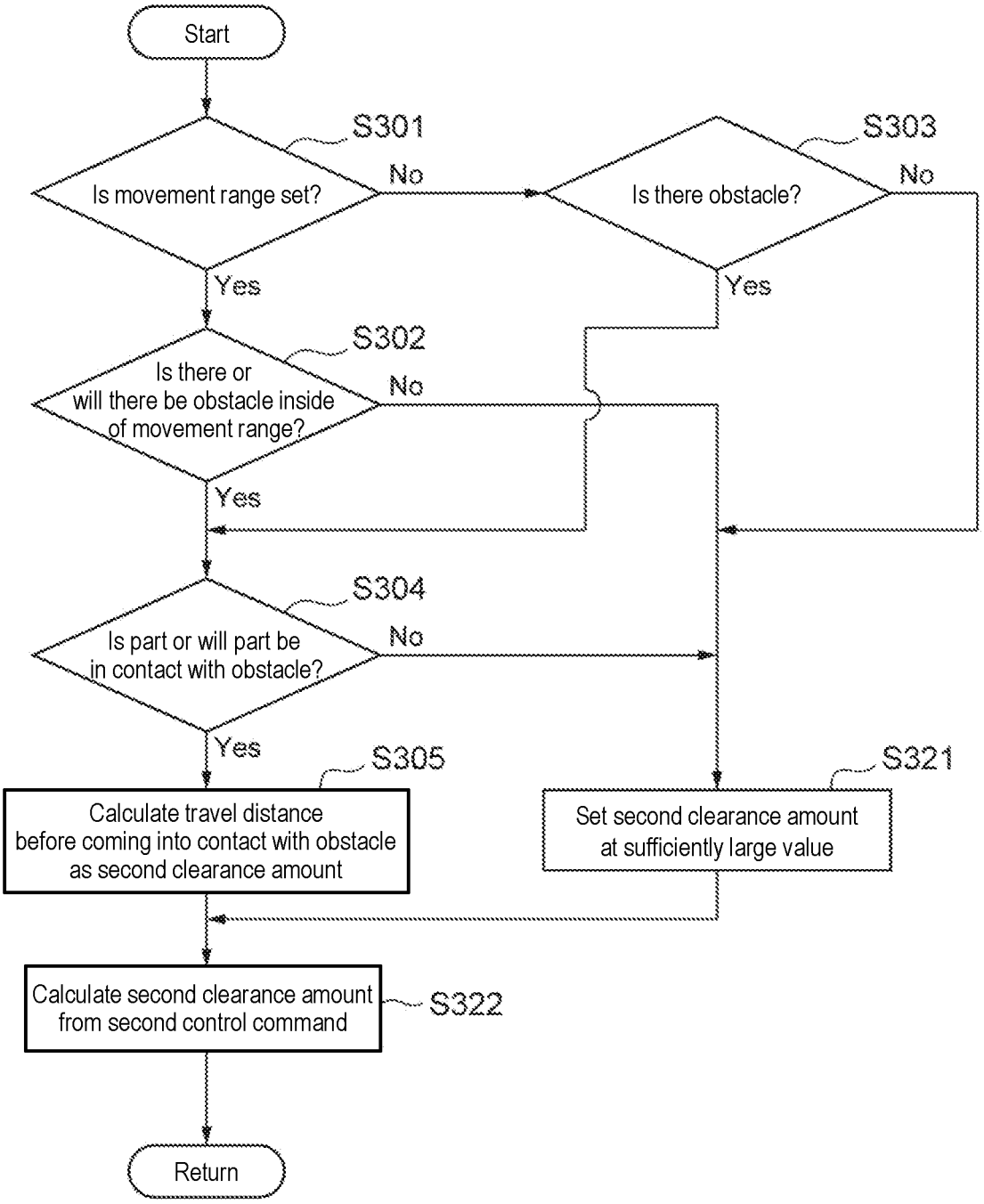
FIG. 8 is a flowchart showing the calculation process of the second control command calculation unit of the control unit according to the third embodiment of the present invention.

Meanwhile, the second control command calculation unit 109 of the third embodiment performs the calculation illustrated in the flowchart of FIG. 8. The calculation in S301 to S305 of FIG. 8 is equal to that of the first embodiment (see FIG. 5). In the third embodiment, if a part of the traveling body 10, the turning body 20, the boom 31, the arm 33, and the bucket 35 is not or is not expected to be in contact with the obstacle (S304: No) or if there is no obstacle in S302 or S303 (S302, S303: No), a sufficiently larger value than a clearance amount X2, which corresponds to a second speed limit value of the maximum speed in FIG. 9 (described later), is set as a second clearance amount (S321). Then, the second control command calculation unit 109 calculates a second speed limit value from the second clearance amount using FIG. 9 and outputs the obtained value as a second control command (S322).

The second speed limit value of FIG. 9 is a speed limit value (i.e., upper speed limit) for controlling the hydraulic actuators 13*a*, 13*b*, 27, 32, 34, 36 to decelerate and stop, and is set such that the larger the second clearance amount, the larger the second speed limit value (in other words, the smaller the second clearance amount, the smaller the second speed limit value). The value in FIG. 9 may be a preset fixed value or may be a value that may vary such that the larger the downward inclination, the smaller the value in consideration of the fact that the hydraulic excavator 1 is less likely to stop in the downward slope.

Since an obstacle such as a worker or a dump truck, for example, may move, in order to perform the deceleration and stop control with clearance with respect to the obstacle (i.e., obstacle entering the movement range), the second speed limit value used in the second control command calculation unit 109 is set smaller than the first speed limit value used in the first control command calculation unit 108 at least in a part of the range (specifically, when the first clearance amount is larger than a predetermined lower limit corresponding to a first speed limit value of 0, and the second clearance amount is smaller than a predetermined upper limit corresponding to a second speed limit value of the maximum speed), even if the first clearance amount is equal to the second clearance amount. In addition, the second speed limit value used in the second control command calculation unit 109 may be a relatively small value in consideration of errors in the position detected in the obstacle position detection units 56*a*, 56*b*.

The control execution unit 110 of the third embodiment selects a control command with a smaller value from the first control command (i.e., first speed limit value) received from the first control command calculation unit 108 and the second control command (i.e., second speed limit value) received from the second control command calculation unit 109 (in other words, a control command that may more rapidly decelerate the hydraulic actuators 13*a*, 13*b*, 27, 32, 34, 36, consequently the body (i.e., the traveling body 10, the turning body 20) or the work implement (i.e., the boom 31, the arm 33, and the bucket 35 of the front work implement 30)), and sets the selected value as a travel speed limit value. When the travel speed is larger than the travel speed limit value, the control execution unit 110 controls the pilot pressure control solenoid valves 45*a* to 45*d* to limit the forward-traveling-L pilot pressure Pa, the backward-traveling-L pilot pressure Pb, the forward-traveling-R pilot pressure Pc, and the backward-traveling-R pilot pressure Pd acting on the control valve 44 in order to reduce the travel speed to the travel speed limit value or smaller (specifically, to perform control so that, when the rotation speed of the hydraulic motors for traveling 13*a*, 13*b* serving as the hydraulic actuators is larger than a rotation speed limit value corresponding to the travel speed limit value, the rotation speed of the hydraulic motors for traveling 13*a*, 13*b* is reduced to the rotation speed limit value or smaller).

According to the above-described control, the travel speed is reduced as the body (i.e., the traveling body 10, the turning body 20) or the work implement (i.e., the boom 31, the arm 33, and the bucket 35 of the front work implement 30) approaches the outside of the set movement range or the obstacle, and thus, it is possible to reduce the possibility that the body (i.e., the traveling body 10, the turning body 20) or the work implement (i.e., the boom 31, the arm 33, and the bucket 35 of the front work implement 30) moves beyond the set movement range or comes into contact with the detected obstacle.

As described above, in the third embodiment, the control unit 100 includes the first control command calculation unit 108 adapted to calculate the first control command to control the actuators based on the movement range, the second control command calculation unit 109 adapted to calculate the second control command to control the actuators based on the position of the obstacle inside of the movement range or the position of the obstacle when the movement range is not set, and the control execution unit 110 adapted to perform control of the actuators by selecting, from the first control command and the second control command, a control command that more rapidly decelerates the work implement or the body.

In addition, the first control command calculation unit 108 calculates a clearance amount before the work implement or the body moves beyond the movement range and sets the obtained value as a first clearance amount. The first control command calculation unit 108 sets a first speed limit value of the work implement or the body such that the larger the first clearance amount, the larger the first speed limit value, and sets the obtained value as the first control command. The second control command calculation unit 109 calculates a clearance amount before the work implement or the body comes into contact with the obstacle inside of the movement range or the obstacle when the movement range is not set, and sets the obtained value as a second clearance amount. The second control command calculation unit 109 sets a second speed limit value of the work implement or the body such that the larger the second clearance amount, the larger the second speed limit value, and sets the obtained value as the second control command. The control execution unit 110 selects a control command with a smaller value from the first speed limit value and the second speed limit value as a speed limit value. When the speed of the actuators is higher than the speed limit value, the control execution unit 110 performs control such that the speed of the actuators is lower than or equal to the speed limit value. If the first clearance amount is larger than a predetermined lower limit and the second clearance amount is smaller than a predetermined upper limit, the second speed limit value is smaller than the first speed limit value even if the first clearance amount is equal to the second clearance amount.

Here, since the second speed limit value is smaller than the first speed limit value even if the first clearance amount is equal to the second clearance amount, it is possible to perform the deceleration and stop control with respect to the obstacle with clearance.

As described above, also in the third embodiment, the deceleration control is performed with respect to the obstacle with clearance, whereas the deceleration control is performed with respect to the movement range with relatively small clearance (i.e., with a minimum clearance). Thus, as long as a movement range is set in advance so as to avoid entry of a worker or a dump truck, for example, into the set movement range, it is possible to reduce the frequency of decelerating the body and suppress decrease in work efficiency. Furthermore, since the work machine controls the body to decelerate with clearance when the worker or the dump truck, for example, enters the movement range of the present work machine, it is possible to reduce the possibility of contacting the worker or the dump truck, for example.

Fourth Embodiment

Next, a fourth embodiment of the present invention will be described.

The fourth embodiment is equal to the third embodiment except that the second control command calculation unit 109 of the control unit 100 performs calculation different from that of the third embodiment.

Figure 10:
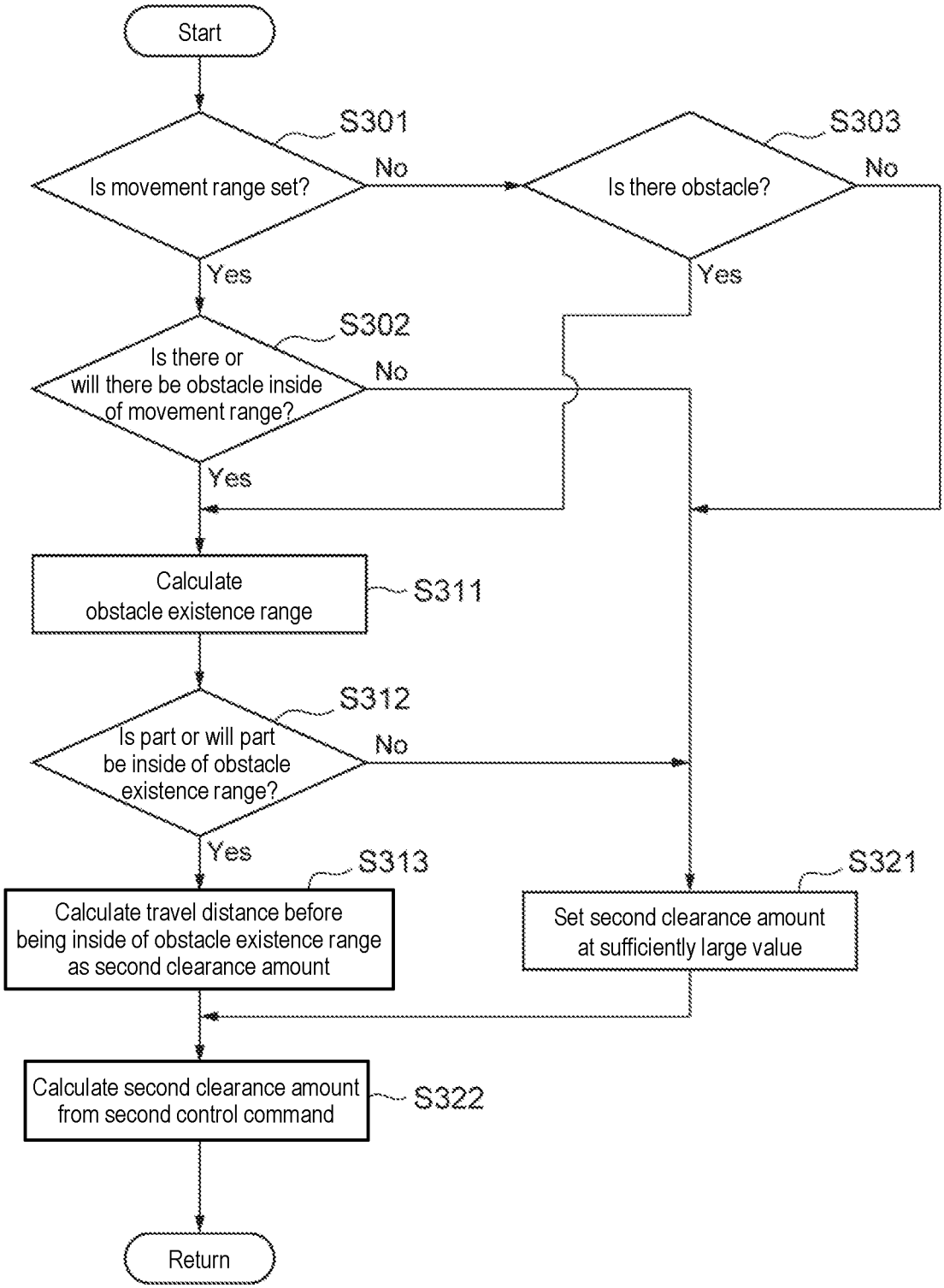
FIG. 10 is a flowchart showing the calculation process of the second control command calculation unit of the control unit according to a fourth embodiment of the present invention.

The second control command calculation unit 109 of the fourth embodiment performs the calculation illustrated in the flowchart of FIG. 10. The calculation in S301 to S303, S321, S322 of FIG. 10 is equal to that of the third embodiment (see FIG. 8). Further, the calculation in S311 to S313 of FIG. 10 is equal to that of the second embodiment (see FIG. 6).

In the fourth embodiment, since the deceleration control is performed with respect to the obstacle existence range that is set to the periphery of the obstacle, the deceleration control with respect to the obstacle itself is performed with clearance. Thus, unlike the third embodiment, the second speed limit value used in the second control command calculation unit 109 need not be smaller than the first speed limit value used in the first control command calculation unit 108. In one example, the second speed limit value may be equal to the first speed limit value.

As described above, in the fourth embodiment, the first control command calculation unit 108 calculates a clearance amount before the work implement or the body moves beyond the movement range and sets the obtained value as a first clearance amount. The first control command calculation unit 108 sets a first speed limit value of the work implement or the body such that the larger the first clearance amount, the larger the first speed limit value, and sets the obtained value as the first control command. The second control command calculation unit 109 sets, as an obstacle existence range, a periphery of the obstacle inside of the movement range or a periphery of the obstacle when the movement range is not set, calculates a clearance amount before the work implement or the body enters the obstacle existence range, and sets the obtained value as a second clearance amount. The second control command calculation unit 109 sets a second speed limit value of the work implement or the body such that the larger the second clearance amount, the larger the second speed limit value, and sets the obtained value as the second control command. The control execution unit 110 selects a smaller value from the first speed limit value and the second speed limit value as a speed limit value. When the speed of the actuators is higher than the speed limit value, the control execution unit 110 performs control such that the speed of the actuators is lower than or equal to the speed limit value.

As described above, also in the fourth embodiment, the deceleration control is performed with respect to the obstacle with clearance, whereas the deceleration control is performed with respect to the movement range with relatively small clearance (i.e., with a minimum clearance). Thus, as long as a movement range is set in advance so as to avoid entry of a worker or a dump truck, for example, into the set movement range, it is possible to reduce the frequency of decelerating the body and suppress decrease in work efficiency. Furthermore, since the work machine controls the body to decelerate with clearance when the worker or the dump truck, for example, enters the movement range of the present work machine, it is possible to reduce the possibility of contacting the worker or the dump truck, for example.

Fifth Embodiment

Next, a fifth embodiment of the present invention will be described.

The fifth embodiment is equal to the first embodiment except that a method for controlling the pilot pressure control solenoid valves 45*a* to 451 performed by the control unit 100 is different from that of the first embodiment.

In the above-described first embodiment, the deceleration and stop control of the body (i.e., the traveling body 10, the turning body 20) is performed by controlling the pilot pressure control solenoid valves 45*a* to 45*d* that control the pilot pressures Pa to Pd associated with traveling, among the pilot pressure control solenoid valves 45*a* to 45*l*. In the fifth embodiment, the deceleration and stop control of the body (i.e., the turning body 20) is performed by controlling the pilot pressure control solenoid valves 45*e*, 45*f* that control the pilot pressures Pe, Pf associated with turning.

Figure 11:
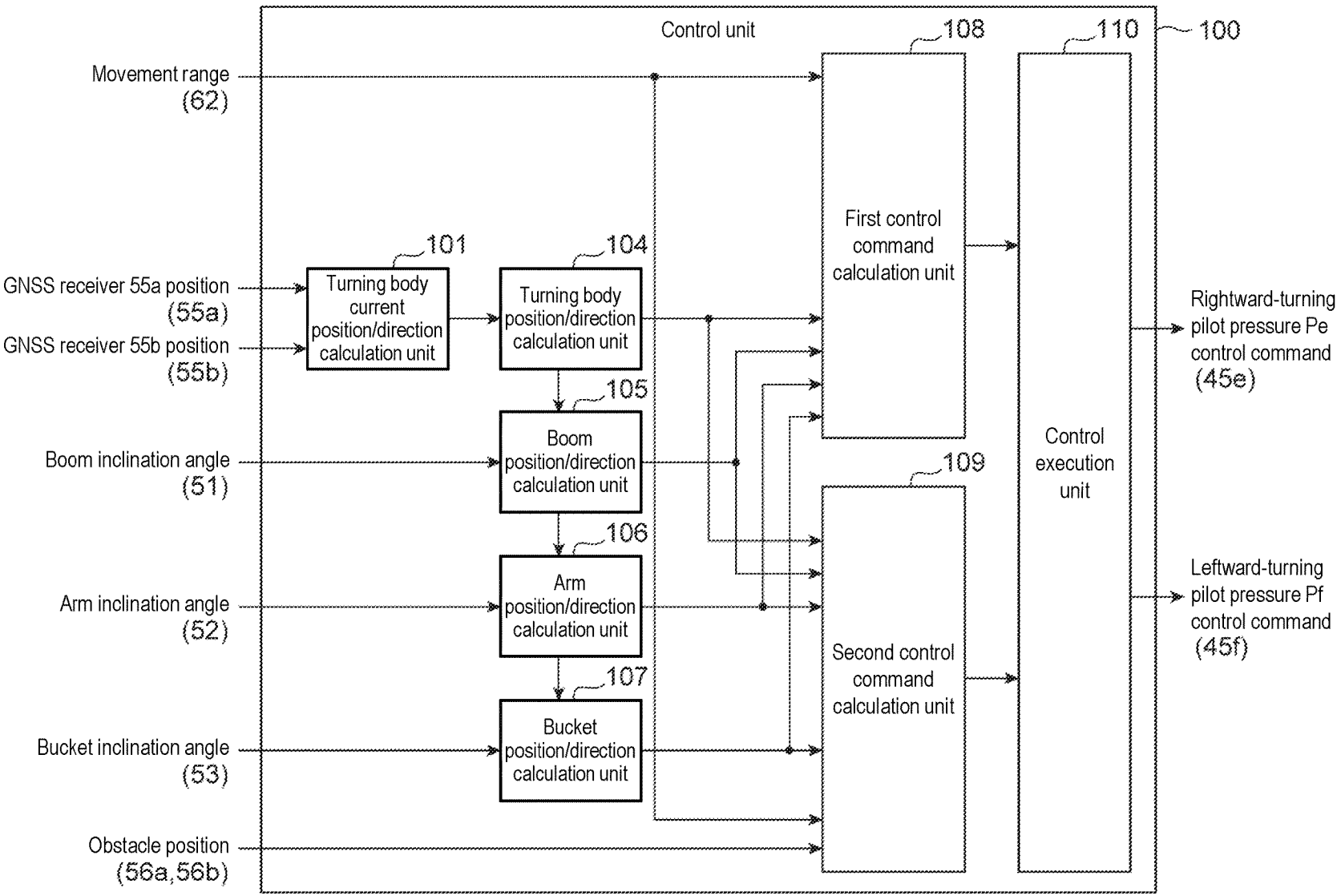
FIG. 11 is a functional block diagram of the control unit of a fifth embodiment of the present invention.

FIG. 11 is a functional block diagram of the control unit 100 according to the fifth embodiment of the present invention. FIG. 11 illustrates one example of the method for controlling the pilot pressure control solenoid valves 45*a* to 45*l* performed by the control unit 100, particularly one example of the method for controlling the pilot pressure control solenoid valves 45*e*, 45*f* that control the pilot pressures Pe, Pf associated with turning, among the pilot pressure control solenoid valves 45*a* to 45*l*. The calculation in the turning body current position/direction calculation unit 101, the boom position/direction calculation unit 105, the arm position/direction calculation unit 106, and the bucket position/direction calculation unit 107 in FIG. 11 is equal to that of the first embodiment (see FIG. 3). However, the traveling body current position/direction calculation unit 102 and the traveling body position/direction calculation unit 103 of the first embodiment are omitted in the fifth embodiment, and the calculation in the turning body position/direction calculation unit 104, the first control command calculation unit 108, the second control command calculation unit 109, and the control execution unit 110 in the fifth embodiment is different from that of the first embodiment.

The turning body position/direction calculation unit 104 is adapted to calculate a future direction of the turning body 20 in the turning at a maximum angular velocity on the basis of the current direction of the turning body 20 calculated in the turning body current position/direction calculation unit 101. For example, the turning body position/direction calculation unit 104 calculates directions of the turning body 20 after a lapse of 0.1 seconds, 0.2 seconds, 0.3 seconds, . . . , 2.0 seconds in the rightward turning at a maximum angular velocity and directions of the turning body 20 after a lapse of 0.1 seconds, 0.2 seconds, 0.3 seconds, . . . , 2.0 seconds in the leftward turning at a maximum angular velocity. Suppose that the future position of the turning body 20 is equal to the current position of the turning body 20 calculated in the turning body current position/direction calculation unit 101. It should be noted that when the turning body 20 is currently turning, the turning body position/direction calculation unit 104 may calculate future directions of the turning body 20 only in the current turning direction. The turning body position/direction calculation unit 104 is adapted to output altogether information on the future position and direction of the turning body 20 calculated in the turning body position/direction calculation unit 104 and information on the current position and direction of the turning body 20 calculated in the turning body current position/direction calculation unit 101.

Figure 12:
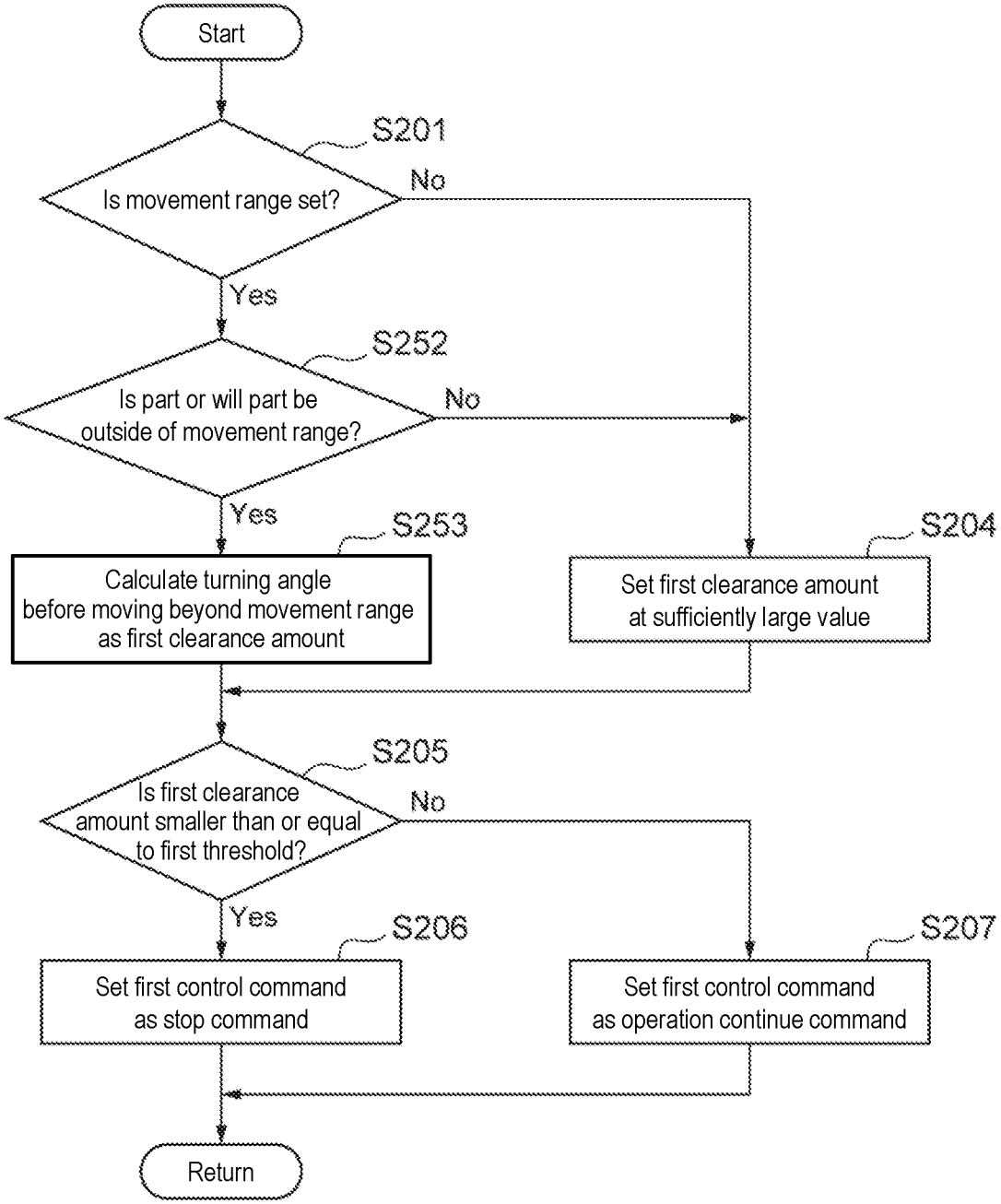
FIG. 12 is a flowchart showing the calculation process of the first control command calculation unit of the control unit according to the fifth embodiment of the present invention.

The first control command calculation unit 108 performs the calculation illustrated in the flowchart of FIG. 12. This calculation of the fifth embodiment is equal to that of the first embodiment except the calculation in S252, S253 (or S202, S203 of the first embodiment) (see FIG. 4).

In the fifth embodiment, if a movement range is set in the movement range setting unit 62 (S201: Yes), the first control command calculation unit 108 determines whether a part of the turning body 20, the boom 31, the arm 33, and the bucket 35 is or is expected to be outside of the movement range (in the first embodiment, the first control command calculation unit 108 also determines whether the traveling body 10 is or is expected to be outside of the movement range) (S252). If a part of the turning body 20, the boom 31, the arm 33, and the bucket 35 is or is expected to be outside of the movement range (S252: Yes), the first control command calculation unit 108 calculates a turning angle (i.e., clearance amount) before moving beyond the movement range by multiplying a time period before moving beyond the movement range (the time period is zero when a part of the turning body 20, the boom 31, the arm 33, and the bucket 35 is currently outside of the movement range) by the maximum angular velocity in turning, and sets the obtained value as a first clearance amount (S253). Except S252, S253, the first control command calculation unit 108 performs calculation that is equal to that of the first embodiment and sets a first control command (i.e., a stop command or an operation continue command).

Figure 13:
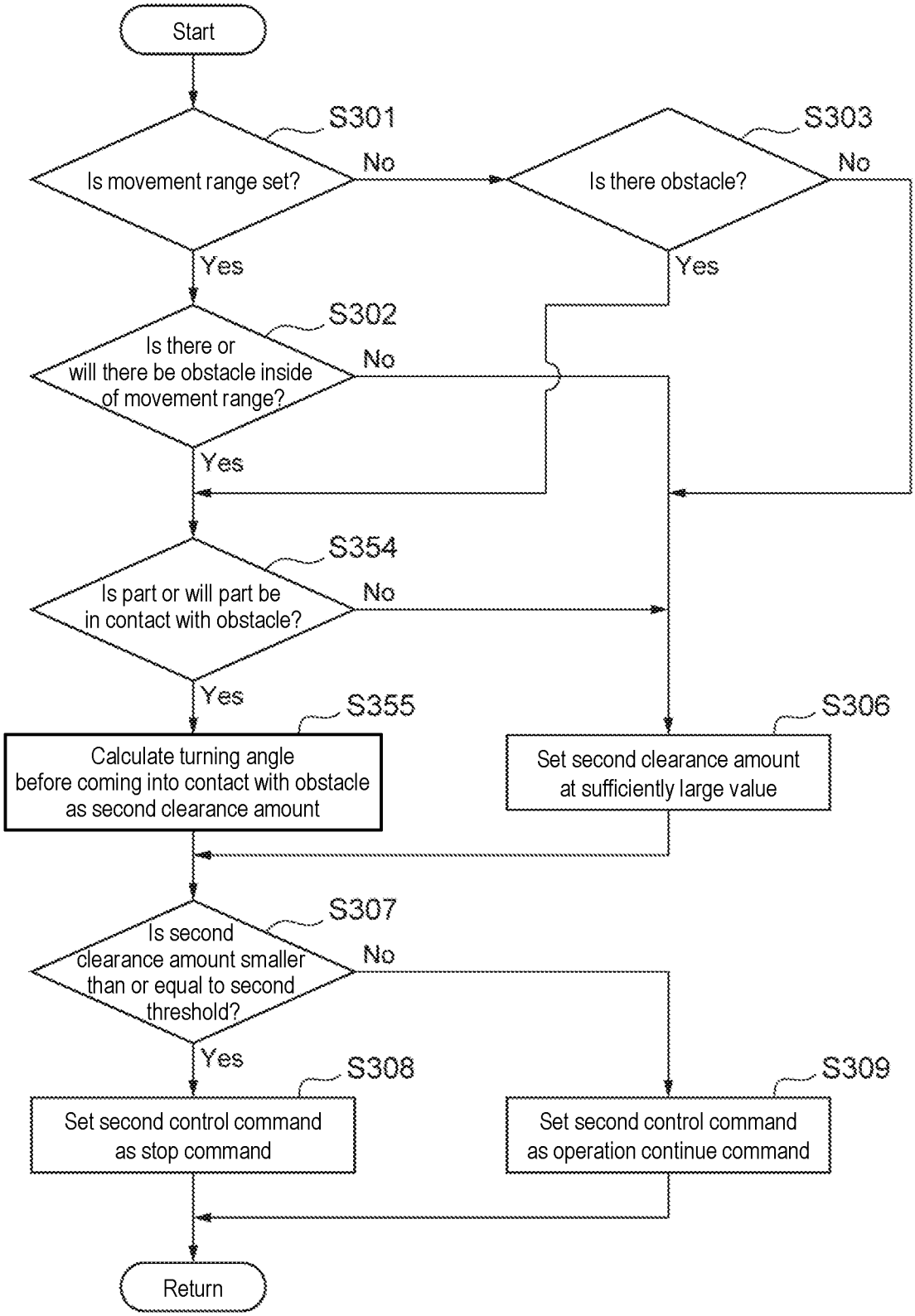
FIG. 13 is a flowchart showing the calculation process of the second control command calculation unit of the control unit according to the fifth embodiment of the present invention.

The second control command calculation unit 109 performs the calculation illustrated in the flowchart of FIG. 13. This calculation of the fifth embodiment is equal to that of the first embodiment except the calculation in S354, S355 (or S304, S305 of the first embodiment) (see FIG. 5).

In the fifth embodiment, if there is an obstacle in S302 or S303 (S302, S303: Yes), the second control command calculation unit 109 determines whether a part of the turning body 20, the boom 31, the arm 33, and the bucket 35 is or is expected to be in contact with the obstacle (in the first embodiment, the second control command calculation unit 109 also determines whether the traveling body 10 is or is expected to be in contact with the obstacle) (S354). If a part of the turning body 20, the boom 31, the arm 33, and the bucket 35 is or is expected to be in contact with the obstacle (S354: Yes), the second control command calculation unit 109 calculates a turning angle (i.e., clearance amount) before coming into contact with the obstacle by multiplying a time period before coming into contact with the obstacle (the time period is zero when a part of the turning body 20, the boom 31, the arm 33, and the bucket 35 is currently in contact with the obstacle) by the maximum angular velocity in turning, and sets the obtained value as a second clearance amount (S355). Except S354, S355, the second control command calculation unit 109 performs calculation that is equal to that of the first embodiment and sets a second control command (i.e., a stop command or an operation continue command).

It should be noted that also in the fifth embodiment, as in the first embodiment, the second threshold set in the second control command calculation unit 109 is set larger than the first threshold set in the first control command calculation unit 108.

Referring back to FIG. 11, when at least one of the first control command received from the first control command calculation unit 108 or the second control command received from the second control command calculation unit 109 is a stop command, the control execution unit 110 selects an appropriate stop command from the first and second control commands, and controls the pilot pressure control solenoid valves 45*e*, 45*f* to cut the rightward-turning pilot pressure Pe and the leftward-turning pilot pressure Pf (i.e., set them to 0 MPa) acting on the control valve 44 in order to stop turning (specifically, control the hydraulic motor for turning 27 serving as the hydraulic actuator to stop).

Specifically, when one of the first control command received from the first control command calculation unit 108 or the second control command received from the second control command calculation unit 109 is a stop command, the control execution unit 110 selects the stop command, and controls the pilot pressure control solenoid valves 45*e*, 45*f* as described above.

Meanwhile, when both of the first control command received from the first control command calculation unit 108 and the second control command received from the second control command calculation unit 109 are stop commands, the control execution unit 110 selects, from the first and second control commands, a stop command that stops the turning at earlier timing (i.e., a stop command that stops the hydraulic motor for turning 27 serving as the hydraulic actuator at earlier timing) and controls the pilot pressure control solenoid valves 45*e*, 45*f* as described above.

At this time, the pilot pressures for the remaining pilot pressure control solenoid valves 45*a* to 45*d*, 45*g* to 45*l* may be cut or may not be cut. Cutting the pilot pressures to stop the pilot pressure control solenoid valves stops all of the actuators as well as turning, and thus, the operator can easily understand the entire operation of the hydraulic excavator 1. The operation other than turning is continued unless the pilot pressures are cut, which enhances convenience.

In either case, the above-described turn stop control can reduce the possibility that the body (i.e., the turning body 20) or the work implement (i.e., the boom 31, the arm 33, and the bucket 35 of the front work implement 30) moves beyond the set movement range or comes into contact with the detected obstacle.

It should be noted that when both of the first control command received from the first control command calculation unit 108 and the second control command received from the second control command calculation unit 109 are operation continue commands, the control execution unit 110 controls the pilot pressure control solenoid valves 45*e*, 45*f* to maintain the rightward-turning pilot pressure Pe and the leftward-turning pilot pressure Pf acting on the control valve 44 in order to continue current turning.

As described above, also in the fifth embodiment, the stop control is performed with respect to the obstacle with clearance, whereas the stop control is performed with respect to the movement range with relatively small clearance (i.e., with a minimum clearance). Thus, as long as a movement range is set in advance so as to avoid entry of a worker or a dump truck, for example, into the set movement range, it is possible to reduce the frequency of stopping the body and suppress decrease in work efficiency. Furthermore, since the work machine controls the body to stop with clearance when the worker or the dump truck, for example, enters the movement range of the present work machine, it is possible to reduce the possibility of contacting the worker or the dump truck, for example.

It should be noted that herein the fifth embodiment has been described as a modification of the first embodiment. However, it is needless to describe in detail that the fifth embodiment may be applicable in combination with the second to fourth embodiments, for example.

Sixth Embodiment

Next, a sixth embodiment of the present invention will be described.

The sixth embodiment is equal to the first embodiment except that a method for controlling the pilot pressure control solenoid valves 45*a* to 45*l* performed by the control unit 100 is different from that of the first embodiment.

In the above-described first embodiment, the deceleration and stop control of the body (i.e., the traveling body 10, the turning body 20) is performed by controlling the pilot pressure control solenoid valves 45*a* to 45*d* that control the pilot pressures Pa to Pd associated with traveling, among the pilot pressure control solenoid valves 45*a* to 45*l*. In the sixth embodiment, the deceleration and stop control of the work implement (i.e., the front work implement 30) is performed by controlling the pilot pressure control solenoid valves 45*g* to 45*l* that control the pilot pressures Pg to Pl associated with movement of the work implement (i.e., the front work implement 30).

Figure 14:
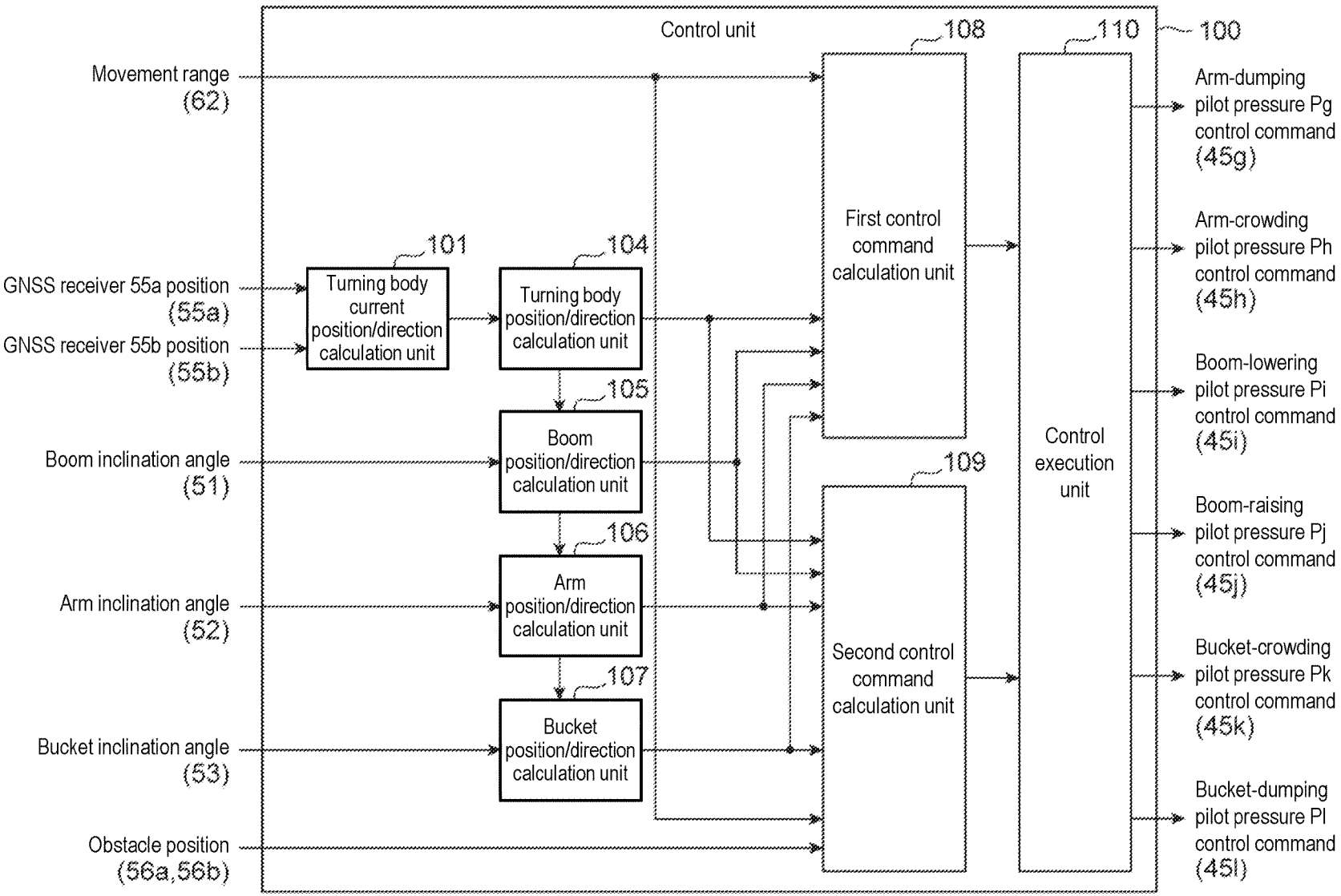
FIG. 14 is a functional block diagram of the control unit of a sixth embodiment of the present invention.

FIG. 14 is a functional block diagram of the control unit 100 according to the sixth embodiment of the present invention. FIG. 14 illustrates one example of the method for controlling the pilot pressure control solenoid valves 45*a* to 45*l* performed by the control unit 100, particularly one example of the method for controlling the pilot pressure control solenoid valves 45*g* to 45*l* that control the pilot pressures Pg to Pl associated with movement of the work implement (i.e., the front work implement 30), among the pilot pressure control solenoid valves 45*a* to 45*l*. The calculation in the turning body current position/direction calculation unit 101 and the bucket position/direction calculation unit 107 in FIG. 14 is equal to that of the first embodiment (see FIG. 3). However, the traveling body current position/direction calculation unit 102 and the traveling body position/direction calculation unit 103 of the first embodiment are omitted in the sixth embodiment, and the calculation (i.e., 104 to 106, 108 to 110) other than the calculation in the traveling body current position/direction calculation unit 102 and the traveling body position/direction calculation unit 103 is different from that of the first embodiment.

The turning body position/direction calculation unit 104 is adapted to output information on the current and future positions and directions of the turning body 20 on an assumption that the current position and direction of the turning body 20 calculated in the turning body current position/direction calculation unit 101 continues in the future.

The boom position/direction calculation unit 105 is adapted to calculate a current position of the coupling portion of the boom 31 that is coupled to the turning body 20 on the basis of the current position and direction of the turning body 20 received from the turning body position/direction calculation unit 104, and calculate a current position of the coupling portion of the boom 31 that is coupled to the arm 33 on the basis of the calculated value of the current position of the coupling portion of the boom 31 that is coupled to the turning body 20 and the inclination angle of the boom 31 detected by the boom inclination angle sensor 51. Then, the boom position/direction calculation unit 105 calculates a future position of the coupling portion of the boom 31 that is coupled to the arm 33 when the boom-lowering is performed at a maximum speed on the basis of the current position of the coupling portion of the boom 31 that is coupled to the arm 33. For example, the boom position/direction calculation unit 105 calculates positions of the coupling portion of the boom 31 that is coupled to the arm 33 after a lapse of 0.1 seconds, 0.2 seconds, 0.3 seconds, . . . , 2.0 seconds. Further, the boom position/direction calculation unit 105 sets a value that is equal to the current and future directions of the turning body 20 received from the turning body position/direction calculation unit 104 as the current and future directions of the boom 31. Then, the boom position/direction calculation unit 105 outputs the current and future positions of the coupling portion of the boom 31 that is coupled to the arm 33 and the current and future directions of the boom 31.

The arm position/direction calculation unit 106 is adapted to calculate a current position of the coupling portion of the arm 33 that is coupled to the bucket 35 on the basis of the current position and direction of the boom 31 received from the boom position/direction calculation unit 105 and the inclination angle of the arm 33 detected by the arm inclination angle sensor 52. Then, the arm position/direction calculation unit 106 calculates a future position of the coupling portion of the arm 33 that is coupled to the bucket 35 when the arm-dumping is performed at a maximum speed on the basis of the current position of the coupling portion of the arm 33 that is coupled to the bucket 35. For example, the arm position/direction calculation unit 106 calculates positions of the coupling portion of the arm 33 that is coupled to the bucket 35 after a lapse of 0.1 seconds, 0.2 seconds, 0.3 seconds, . . . , 2.0 seconds. Further, the arm position/direction calculation unit 106 sets a value that is equal to the current and future directions of the boom 31 received from the boom position/direction calculation unit 105 as the current and future directions of the arm 33. Then, the arm position/direction calculation unit 106 outputs the current and future positions of the coupling portion of the arm 33 that is coupled to the bucket 35 and the current and future directions of the arm 33.

Figure 15:
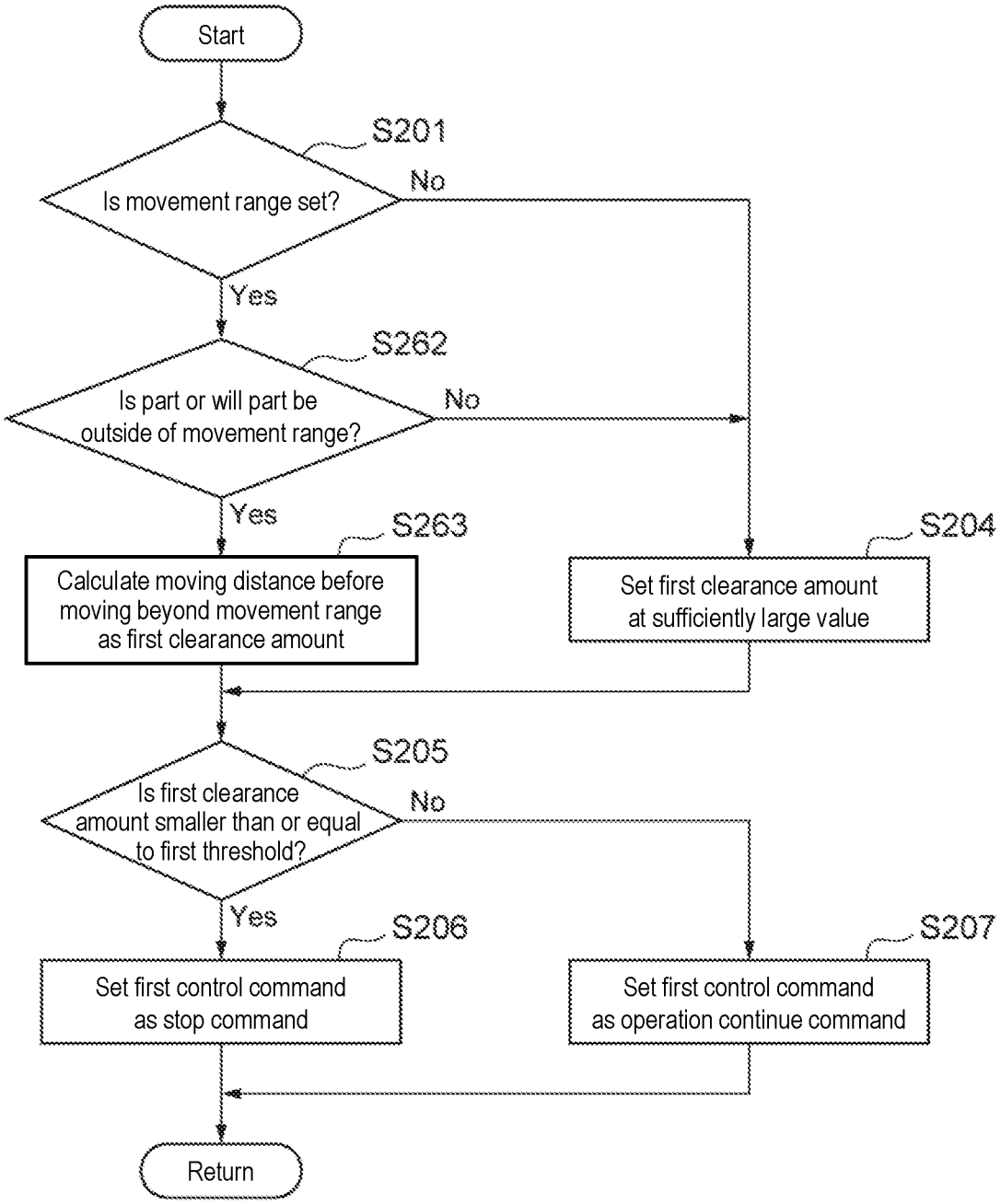
FIG. 15 is a flowchart showing the calculation process of the first control command calculation unit of the control unit according to the sixth embodiment of the present invention.

The first control command calculation unit 108 performs the calculation illustrated in the flowchart of FIG. 15. This calculation of the sixth embodiment is equal to that of the first embodiment except the calculation in S262, S263 (or S202, S203 of the first embodiment) (see FIG. 4).

In the sixth embodiment, if a movement range is set in the movement range setting unit 62 (S201: Yes), the first control command calculation unit 108 determines whether a part of the bucket 35 is or is expected to be outside of the movement range (in the first embodiment, the first control command calculation unit 108 also determines whether the traveling body 10, the turning body 20, the boom 31, and the arm 33 is or is expected to be outside of the movement range) (S262). If a part of the bucket 35 is or is expected to be outside of the movement range (S262: Yes), the first control command calculation unit 108 calculates a moving distance (i.e., clearance amount) before the bucket 35 moves beyond the movement range from the current position (the moving distance is zero when a part of the bucket 35 is currently outside of the movement range), and sets the obtained value as a first clearance amount (S263). It should be noted that the moving distance herein corresponds to a displacement amount (this may also be referred to as the retraction and extension amount) of the boom cylinder 32, the arm cylinder 34, and the bucket cylinder 36 serving as the hydraulic actuators. Except S262, S263, the first control command calculation unit 108 performs calculation that is equal to that of the first embodiment and sets a first control command (i.e., a stop command or an operation continue command).

Figure 16:
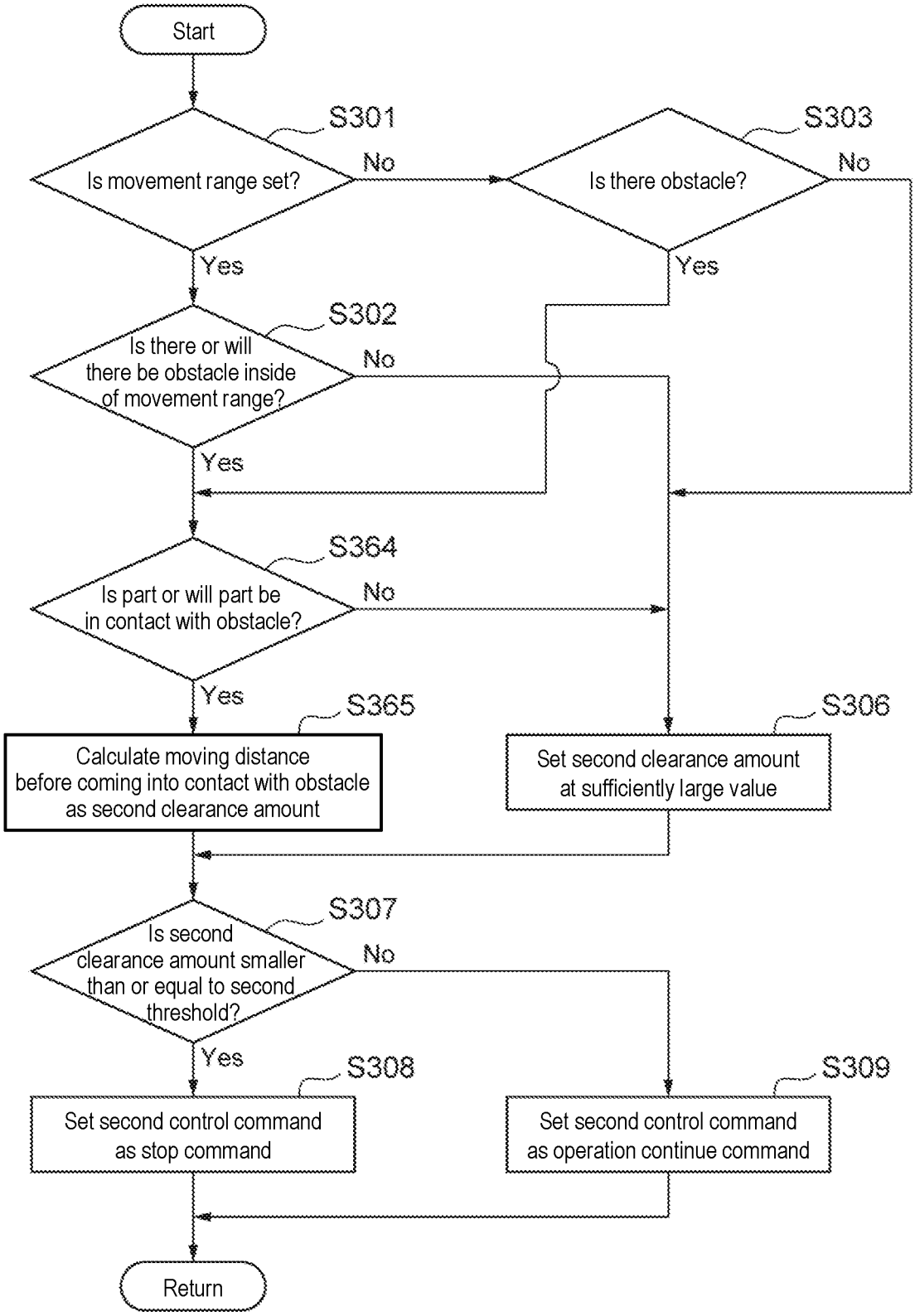
FIG. 16 is a flowchart showing the calculation process of the second control command calculation unit of the control unit according to the sixth embodiment of the present invention.

The second control command calculation unit 109 performs the calculation illustrated in the flowchart of FIG. 16. This calculation of the sixth embodiment is equal to that of the first embodiment except the calculation in S364, S365 (or S304, S305 of the first embodiment) (see FIG. 5).

In the sixth embodiment, if there is an obstacle in S302 or S303 (S302, S303: Yes), the second control command calculation unit 109 determines whether a part of the bucket 35 is or is expected to be in contact with the obstacle (in the first embodiment, the second control command calculation unit 109 also determines whether the traveling body 10, the turning body 20, the boom 31, and the arm 33 is or is expected to be in contact with the obstacle) (S364). If a part of the bucket 35 is or is expected to be in contact with the obstacle (S364: Yes), the second control command calculation unit 109 calculates a moving distance (i.e., clearance amount) before the bucket 35 comes into contact with the obstacle from the current position (the moving distance is zero when a part of the bucket 35 is currently in contact with the obstacle), and sets the obtained value as a second clearance amount (S365). It should be noted that the moving distance herein corresponds to a displacement amount (this may also be referred to as the retraction and extension amount) of the boom cylinder 32, the arm cylinder 34, and the bucket cylinder 36 serving as the hydraulic actuators. Except S364, S365, the second control command calculation unit 109 performs calculation that is equal to that of the first embodiment and sets a second control command (i.e., a stop command or an operation continue command).

It should be noted that also in the sixth embodiment, as in the first embodiment, the second threshold set in the second control command calculation unit 109 is set larger than the first threshold set in the first control command calculation unit 108.

Referring back to FIG. 14, when at least one of the first control command received from the first control command calculation unit 108 or the second control command received from the second control command calculation unit 109 is a stop command, the control execution unit 110 selects an appropriate stop command from the first and second control commands, and controls the pilot pressure control solenoid valves 45*g* to 45*l* to cut the arm-dumping pilot pressure Pg, the arm-crowding pilot pressure Ph, the boom-lowering pilot pressure Pi, the boom-raising pilot pressure Pj, the bucket-crowding pilot pressure Pk, and the bucket-dumping pilot pressure Pl (i.e., set them to 0 MPa) acting on the control valve 44 in order to stop movement of the front work implement 30 (specifically, control the boom cylinder 32, the arm cylinder 34, and the bucket cylinder 36 serving as the hydraulic actuators to stop).

Specifically, when one of the first control command received from the first control command calculation unit 108 or the second control command received from the second control command calculation unit 109 is a stop command, the control execution unit 110 selects the stop command, and controls the pilot pressure control solenoid valves 45*g* to 45*l* as described above.

Meanwhile, when both of the first control command received from the first control command calculation unit 108 and the second control command received from the second control command calculation unit 109 are stop commands, the control execution unit 110 selects, from the first and second control commands, a stop command that stops the movement of the front work implement 30 at earlier timing (i.e., a stop command that stops the boom cylinder 32, the arm cylinder 34, and the bucket cylinder 36 serving as the hydraulic actuators at earlier timing) and controls the pilot pressure control solenoid valves 45*g* to 45*l* as described above.

At this time, the pilot pressures for the remaining pilot pressure control solenoid valves 45*a* to 45*f* may be cut or may not be cut. Cutting the pilot pressures to stop the pilot pressure control solenoid valves stops all of the actuators as well as movement of the front work implement 30, and thus, the operator can easily understand the entire operation of the hydraulic excavator 1. The operation other than the movement of the front work implement 30 is continued unless the pilot pressures are cut, which enhances convenience.

In either case, the above-described movement stop control of the front work implement 30 can reduce the possibility that the work implement (i.e., the boom 31, the arm 33, and the bucket 35 of the front work implement 30) moves beyond the set movement range or comes into contact with the detected obstacle.

It should be noted that when both of the first control command received from the first control command calculation unit 108 and the second control command received from the second control command calculation unit 109 are operation continue commands, the control execution unit 110 controls the pilot pressure control solenoid valves 45*g* to 45*l* to maintain the arm-dumping pilot pressure Pg, the arm-crowding pilot pressure Ph, the boom-lowering pilot pressure Pi, the boom-raising pilot pressure Pj, the bucket-crowding pilot pressure Pk, and the bucket-dumping pilot pressure Pl acting on the control valve 44 in order to continue the current movement of the front work implement 30.

As described above, also in the sixth embodiment, the stop control is performed with respect to the obstacle with clearance, whereas the stop control is performed with respect to the movement range with relatively small clearance (i.e., with a minimum clearance). Thus, as long as a movement range is set in advance so as to avoid entry of a worker or a dump truck, for example, into the set movement range, it is possible to reduce the frequency of stopping the work implement and suppress decrease in work efficiency. Furthermore, since the work machine controls the work implement to stop with clearance when the worker or the dump truck, for example, enters the movement range of the present work machine, it is possible to reduce the possibility of contacting the worker or the dump truck, for example.

It should be noted that herein the sixth embodiment has been described as a modification of the first embodiment. However, it is needless to describe in detail that the sixth embodiment may be applicable in combination with the second to fourth embodiments, for example.

As described above, according to the embodiments of the present invention, it is possible to suppress decrease in work efficiency while reducing the possibility of contacting a worker or a dump truck, for example.

Although the embodiments of the present invention have been described in detail above, the present invention is not limited to the aforementioned embodiments, and includes a variety of modifications. The aforementioned embodiments have been described in detail to clearly illustrate the present invention, and the present invention need not include all of the structures described in the embodiments. For example, it is possible to replace a part of a structure of an embodiment with a structure of another embodiment. In addition, it is also possible to add, to a structure of an embodiment, a structure of another embodiment. Further, it is also possible to, for a part of a structure of each embodiment, add, remove, or substitute a structure of another embodiment.

In addition, some or all of the aforementioned structures, functions, and the like may be implemented as hardware by designing them into an integrated circuit, for example. Alternatively, each of the functions may be implemented as software such that a processor analyzes and executes a program that implements each function.

REFERENCE SIGNS LIST

1 Hydraulic excavator (work machine)
10 Traveling body (body)
11*a*, 11*b* Crawler
12*a*, 12*b* Crawler frame
13*a*, 13*b* Hydraulic motor for traveling (actuator)
20 Turning body (body)
21 Turning frame
22 Engine
23 Engine controller
26 Deceleration mechanism
27 Hydraulic motor for turning (actuator)
30 Front work implement (work implement)
31 Boom
32 Boom cylinder (actuator)
33 Arm
34 Arm cylinder (actuator)
35 Bucket
36 Bucket cylinder (actuator)
40 Hydraulic system
41*a*, 41*b* Hydraulic pump
42*a*, 42*b* Regulator
43*a* to 43*d* Pilot valve
44 Control valve
45*a* to 45*l* Pilot pressure control solenoid valve
46*a*, 46*b* Hydraulic oil tank
51 Boom inclination angle sensor
52 Arm inclination angle sensor
53 Bucket inclination angle sensor
54 Turning angle sensor
55*a*, 55*b* GNSS receiver
56*a*, 56*b* Obstacle position detection unit
61 Engine control dial
62 Movement range setting unit
100 Control unit
101 Turning body current position/direction calculation unit
102 Traveling body current position/direction calculation unit
103 Traveling body position/direction calculation unit

104 Turning body position/direction calculation unit
105 Boom position/direction calculation unit
106 Arm position/direction calculation unit
107 Bucket position/direction calculation unit
108 First control command calculation unit
109 Second control command calculation unit
110 Control execution unit

The invention claimed is:

1. A work machine comprising:

a movable body or a work implement movably mounted on a body;

an actuator configured to drive the work implement or the body;

a movement range setting unit configured to set a movement range of the work implement or the body;

an obstacle position detection unit configured to detect a position of an obstacle in vicinity; and a control unit configured to control the actuator, wherein the control unit includes:

a first control command calculation unit configured to calculate a first control command to control the actuator based on the movement range;

a second control command calculation unit configured to calculate a second control command to control the actuator based on a position of the obstacle inside of the movement range; and a control execution unit configured to perform control of the actuator by selecting, from the first control command and the second control command, a control command that stops the work implement or the body at earlier timing or a control command that more rapidly decelerates the work implement or the body, and wherein:

the first control command calculation unit is configured to calculate a clearance amount before the work implement or the body moves beyond the movement range and set a calculated value as a first clearance amount, set the first control command as a stop command when the first clearance amount is smaller than or equal to a first threshold, and set the first control command as an operation continue command when the first clearance amount is larger than the first threshold, the second control command calculation unit is configured to calculate a clearance amount before the work implement or the body comes into contact with the obstacle inside of the movement range and set a calculated value as a second clearance amount, set the second control command as a stop command when the second clearance amount is smaller than or equal to a second threshold, and set the second control command as an operation continue command when the second clearance amount is larger than the second threshold, the control execution unit is configured to control the actuator to stop when at least one of the first control command or the second control command is a stop command, and the second threshold is larger than the first threshold.

2. The work machine according to claim 1, wherein:

the actuator is an actuator for traveling the body, the first control command calculation unit is configured to calculate a travel distance before the work implement or the body moves beyond the movement range and set a calculated value as a first clearance amount, and the second control command calculation unit is configured to calculate a travel distance before the work implement or the body comes into contact with the obstacle or a travel distance before the work implement or the body enters an obstacle existence range that is set to a periphery of the obstacle, and set a calculated value as a second clearance amount.

3. The work machine according to claim 1, wherein:

the actuator is an actuator for turning the body, the first control command calculation unit is configured to calculate a turning angle before the work implement or the body moves beyond the movement range and set a calculated value as a first clearance amount, and the second control command calculation unit is configured to calculate a turning angle before the work implement or the body comes into contact with the obstacle or a turning angle before the work implement or the body enters an obstacle existence range that is set to a periphery of the obstacle, and set a calculated value as a second clearance amount.

4. The work machine according to claim 1, wherein:

the actuator is a cylinder for moving the work implement, the first control command calculation unit is configured to calculate a displacement amount of the actuator before the work implement moves beyond the movement range and set a calculated value as a first clearance amount, and the second control command calculation unit is configured to calculate a displacement amount of the actuator before the work implement comes into contact with the obstacle or a displacement amount of the actuator before the work implement enters an obstacle existence range that is set to a periphery of the obstacle, and set a calculated value as a second clearance amount.

5. The work machine according to claim 1, wherein when the movement range is not set, the second control command calculation unit is configured to calculate a second control command to control the actuator based on a position of the obstacle regardless of location.

6. A work machine comprising:

a movable body or a work implement movably mounted on a body;

an actuator configured to drive the work implement or the body;

a movement range setting unit configured to set a movement range of the work implement or the body;

an obstacle position detection unit configured to detect a position of an obstacle in vicinity; and a control unit configured to control the actuator, wherein the control unit includes:

a first control command calculation unit configured to calculate a first control command to control the actuator based on the movement range;

a second control command calculation unit configured to calculate a second control command to control the actuator based on a position of the obstacle inside of the movement range; and a control execution unit configured to perform control of the actuator by selecting, from the first control command and the second control command, a control command that stops the work implement or the body at earlier timing or a control command that more rapidly decelerates the work implement or the body, and wherein:

the first control command calculation unit is configured to calculate a clearance amount before the work implement or the body moves beyond the movement range and set a calculated value as a first clearance amount, set a first speed limit value of the work implement or the body such that the larger the first clearance amount, the larger the first speed limit value, and set the first speed limit value as the first control command, the second control command calculation unit is configured to calculate a clearance amount before the work implement or the body comes into contact with the obstacle inside of the movement range and set a calculated value as a second clearance amount, set a second speed limit value of the work implement or the body such that the larger the second clearance amount, the larger the second speed limit value, and set the second speed limit value as the second control command, the control execution unit is configured to select a smaller value from the first speed limit value and the second speed limit value as a speed limit value, and when a speed of the actuator is higher than the speed limit value, perform control such that the speed of the actuator is lower than or equal to the speed limit value, and if the first clearance amount is larger than a predetermined lower limit and the second clearance amount is smaller than a predetermined upper limit, the second speed limit value is smaller than the first speed limit value even if the first clearance amount is equal to the second clearance amount.

7. A work machine comprising:

a movable body or a work implement movably mounted on a body;

an actuator configured to drive the work implement or the body;

a movement range setting unit configured to set a movement range of the work implement or the body;

an obstacle position detection unit configured to detect a position of an obstacle in vicinity; and a control unit configured to control the actuator, wherein the control unit includes:

a first control command calculation unit configured to calculate a first control command to control the actuator based on the movement range;

a second control command calculation unit configured to calculate a second control command to control the actuator based on a position of the obstacle inside of the movement range; and a control execution unit configured to perform control of the actuator by selecting, from the first control command and the second control command, a control command that stops the work implement or the body at earlier timing or a control command that more rapidly decelerates the work implement or the body, and wherein:

the first control command calculation unit is configured to calculate a clearance amount before the work implement or the body moves beyond the movement range and set a calculated value as a first clearance amount, set a first speed limit value of the work implement or the body such that the larger the first clearance amount, the larger the first speed limit value, and set the first speed limit value as the first control command, the second control command calculation unit is configured to set a periphery of the obstacle inside of the movement range as an obstacle existence range, calculate a clearance amount before the work implement or the body enters the obstacle existence range and set a calculated value as a second clearance amount, set a second speed limit value of the work implement or the body such that the larger the second clearance amount, the larger the second speed limit value, and set the second speed limit value as the second control command, and the control execution unit is configured to select a smaller value from the first speed limit value and the second speed limit value as a speed limit value, and when a speed of the actuator is higher than the speed limit value, perform control such that the speed of the actuator is lower than or equal to the speed limit value.

* * * * *